US010606205B2

(12) United States Patent
Shibuya

(10) Patent No.: US 10,606,205 B2
(45) Date of Patent: Mar. 31, 2020

(54) IMAGE FORMING APPARATUS

(71) Applicant: CANON KABUSHIKI KAISHA, Tokyo (JP)

(72) Inventor: Ryota Shibuya, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 39 days.

(21) Appl. No.: 16/041,540

(22) Filed: Jul. 20, 2018

(65) Prior Publication Data

US 2019/0033767 A1 Jan. 31, 2019

(30) Foreign Application Priority Data

Jul. 31, 2017 (JP) ..... 2017-147661

(51) Int. Cl.
*G03G 21/18* (2006.01)
*G03G 15/00* (2006.01)
*G03G 21/16* (2006.01)

(52) U.S. Cl.
CPC ..... *G03G 15/6511* (2013.01); *G03G 21/1619* (2013.01); *G03G 15/6555* (2013.01); *G03G 15/751* (2013.01); *G03G 2215/00396* (2013.01)

(58) Field of Classification Search
CPC ..... G03G 15/6511; G03G 21/1619; G03G 21/1647; G03G 21/1821; G03G 2221/1657
USPC ..... 399/107, 110, 111, 113, 167
See application file for complete search history.

(56) References Cited

U.S. PATENT DOCUMENTS 6,377,776 B1 * 4/2002 Orchard, II ..... G03G 15/2064 100/168
6,741,826 B2 * 5/2004 Park ..... G03G 15/1615 399/167
7,796,904 B2 * 9/2010 Kwon ..... G03G 15/08 399/223
7,881,637 B2 * 2/2011 Keilty ..... G03G 15/0121 399/228
8,630,556 B2 * 1/2014 Yamada ..... G03G 15/2032 399/122
9,229,364 B2 * 1/2016 Murakami ..... G03G 15/0875

FOREIGN PATENT DOCUMENTS

JP H08123281 A 5/1996
JP 2016090793 A 5/2016
WO 2016157285 A1 10/2016

* cited by examiner

*Primary Examiner* — Hoan H Tran
(74) *Attorney, Agent, or Firm* — Canon USA, Inc., IP Division

(57) ABSTRACT

Radius increased areas, radius decreased areas, and rotation stop areas are arranged in peripheral surfaces of first and second cams. In a state in which a portion in the peripheral surface of the first cam to which the first cam follower is contacting is positioned at an upstream end portion of the radius increased area, θ1 is a rotation amount of the first cam from the end portion needed until the first cam follower contacts the rotation stop area, and in a state in which a portion in the peripheral surface of the second cam to which the second cam follower is contacting is positioned at an upstream end portion of the radius increased area, θ2 is a rotation amount of the second cam from the end portion needed until the second cam follower contacts the rotation stop area. θ1<θ2 is satisfied.

20 Claims, 12 Drawing Sheets

IMAGE FORMING APPARATUS

BACKGROUND OF THE INVENTION

Field of the Invention

The present disclosure relates to an electrophotographic system image forming apparatus, such as an electrophotographic copying machine, an electrophotographic printer (an LED printer, a laser printer, etc.), a facsimile machine, or a word processor.

Description of the Related Art

In an electrophotographic system image forming apparatus, there is a contact developing system in which development is performed during an image-forming period by having a photosensitive drum and a development roller contact each other. From the viewpoint of stabilizing image quality and increasing lives of the photosensitive drum and the development roller, it is desirable that, in the contact developing system, the photosensitive drum and the development roller be separated from each other during a non-image-forming period.

A patent literature, International Publication No. WO2016/157285, discloses a configuration in which an apparatus main body includes cams provided in vicinities of two end portions of a development roller in an axial direction, in which the development roller is pressed against a photosensitive drum and is separated from the photosensitive drum by way of rotational movements of the cams. In the apparatus in the patent literature, the cams are fixed to a shaft rotatably provided on a frame member. Furthermore, by driving a gear provided on one end of the shaft and by rotational movement of the shaft and the cams in an integral manner, cam followers engaged with a frame that supports the development roller are moved to perform the pressing and separation of the development roller. Furthermore, by stopping and maintaining the cams at predetermined stop positions, the development roller can be positioned while being pressed against or separated from the photosensitive drum.

However, when the development roller is pressed against or separated from the photosensitive drum, since loads are, through cam followers, applied to the two cams disposed in the vicinities of the two end portions of the cam shaft in the axial direction, the cam shaft becomes elastically deformed and twisted. Particularly, due to the twisting, the rotation of the cam that is farther away from a drive portion and that has a long driving force transmission path becomes delayed relative to the rotation of the cam that is near the drive portion and that has a short driving force transmission path. As a result, a concern that the cam with the long driving force transmission path cannot reach the stop position is encountered.

Furthermore, the cams are abutted against rotation restricting portions provided in the cam followers or the like to stop the cams at predetermined stop positions. After the cam shaft is twisted and elastically deformed with the loads, when the elastic deformation is released, the speed of the cam increases. Accordingly, when the cam, the speed of which has been increased, abuts against the rotation restricting portion, sound of the cam impinging against the rotation restricting portion may become increased when the cam is stopped at the desired stop position.

SUMMARY OF THE INVENTION

The present disclosure provides an image forming apparatus capable of, in a case in which a rotation of a first cam between two cams becomes delayed relative to a rotation of a second cam, preventing a first cam from not reaching a stop position, and/or preventing a cam from coming into contact with a rotation restricting portion in a state in which the speed of the cam is high.

The present disclosure is an image forming apparatus that forms an image on a recording material, the image forming apparatus including a drive source, a first cam that comes in contact with a first cam follower, the first cam moving the first cam follower by being rotated by driving force transmitted thereto from the drive source, and a second cam that comes in contact with a second cam follower, the second cam moving the second cam follower by being rotated by driving force transmitted thereto from the drive source. In the image forming apparatus, peripheral surfaces of the first and second cams each include, a radius increased area in which a distance between a portion to which a relevant one of the first and second cam follower comes in contact and a rotation center of a relevant one of the first and second cam becomes larger as a relevant one of the first or second cam rotates, a radius decreased area in which a distance between a portion to which a relevant cam follower comes in contact and the rotation center of a relevant one of the first and second cam becomes smaller as a relevant one of the first or second cam rotates, and a rotation stop area that is capable of stopping a relevant one of the first and second cam by coming into contact with a relevant cam follower, in which the radius increased area, the radius decreased area, and the rotation stop area are arranged on the peripheral surface of the first or second cam so as to be aligned in that order from a downstream side towards an upstream side in a rotation direction of the first or second cam, in which a second driving force transmission path through which the driving force is transmitted from the drive source to the second cam is longer than a first driving force transmission path through which the driving force is transmitted from the drive source to the first cam, and in which $\theta 1<\theta 2$ is satisfied, where in a state in which a portion in the peripheral surface of the first cam to which the first cam follower is in contact is positioned at an end portion of the radius increased area on an upstream side in the rotation direction, when the end portion is a starting point, a rotation amount of the first cam needed until the first cam follower comes in contact with the rotation stop area is $\theta 1$, and in a state in which a portion in the peripheral surface of the second cam to which the second cam follower is in contact is positioned at an end portion of the radius increased area on an upstream side in the rotation direction, when the end portion is a starting point, a rotation amount of the second cam needed until the second cam follower comes in contact with the rotation stop area is $\theta 2$.

Further features and aspects of the disclosure will become apparent from the following description of numerous example embodiments with reference to the attached drawings.

DESCRIPTION OF THE EMBODIMENTS

First Example Embodiment

Figure 1:
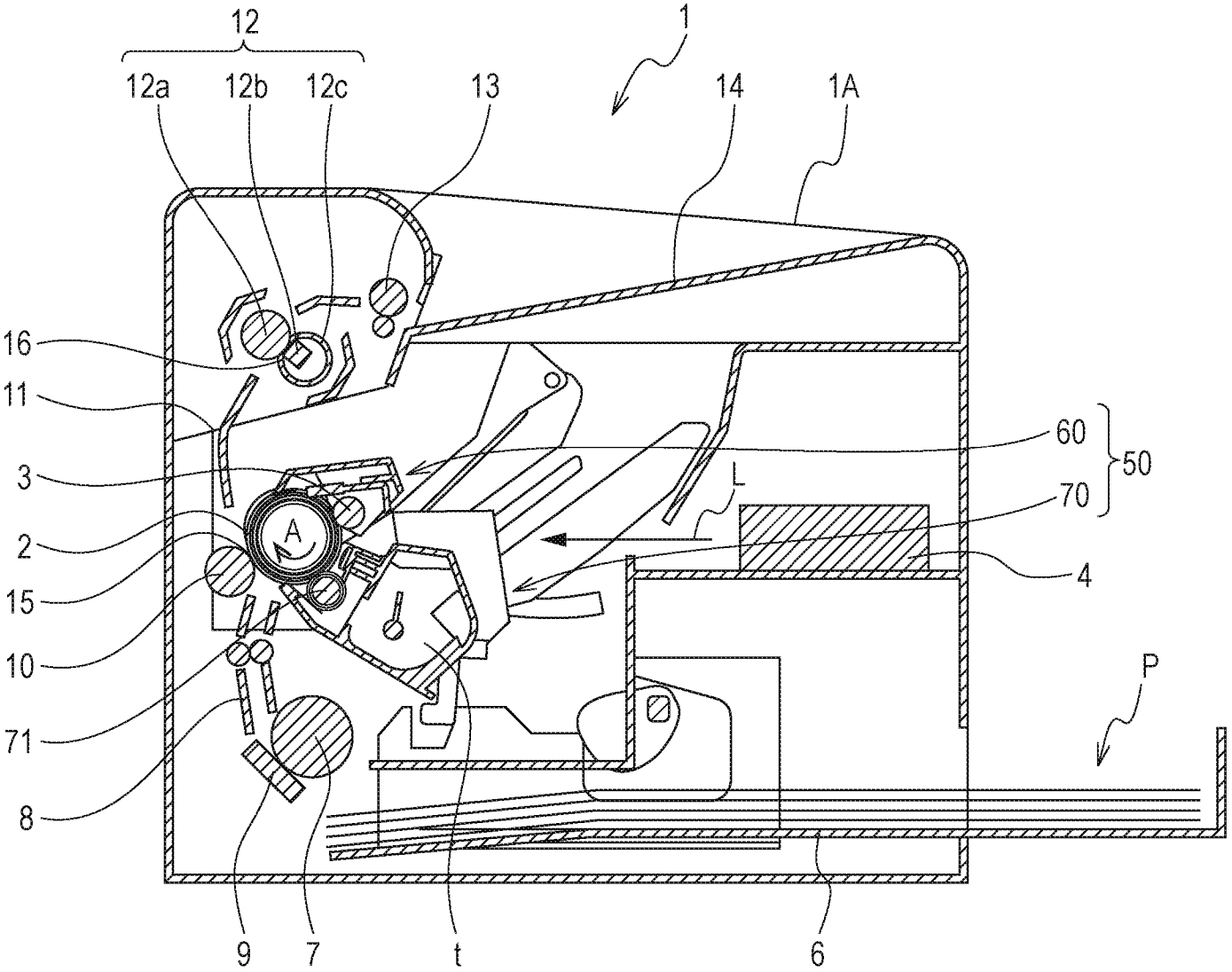
FIG. 1 is a cross-sectional view of an example image forming apparatus.

Referring first to FIG. 1, an overall configuration of the present example embodiment will be described. FIG. 1 is a cross-sectional view of an image forming apparatus 1 inside of which a process cartridge 50 is mounted. On the basis of image information received from an external device such as a personal computer, the image forming apparatus 1 forms an image on a recording material P (recording paper, an OHP sheet, or fabric, for example) with developer through an electrophotographic image forming process. FIG. 1 illustrates a state in which the process cartridge 50 including a drum cartridge 60 and a developing cartridge 70 is mounted in an apparatus main body 1A.

Configuration of Example Image Forming Apparatus

A structure of the image forming apparatus 1 will be described with reference to FIG. 1. By rotating a photosensitive drum (a photosensitive member) 2 in an arrow A direction, a surface of the photosensitive drum 2 is uniformly charged with a charge roller 3 serving as a charging device. The photosensitive drum 2 is irradiated with a laser beam L from an optical member (an exposing device) 4 in accordance with image information so that an electrostatic latent image according to the image information is formed on the photosensitive drum 2. A toner image (a developer image) is formed by supplying (developing) toner (developer) t carried on a development roller 71, serving as a developer bearing member, to the electrostatic latent image on the photosensitive drum 2.

Meanwhile, synchronizing with the formation of the toner image, the recording materials P set on a feeding cassette 6 is separated and fed sheet by sheet with a pickup roller 7 and a pressure contact member 9 that is in pressure contact therewith. Furthermore, the recording material P is conveyed along a conveyance guide 8 to a transfer roller 10 serving as a transfer device. Subsequently, the recording material P passes through a transfer nip portion 15 formed between the photosensitive drum 2 and the transfer roller 10 to which a specific voltage is applied. In the above process, the toner image formed on the photosensitive drum 2 is transferred onto the recording material P. The recording material P to which the toner image has been transferred is conveyed towards a fixing device 12 with a conveyance guide 11. The fixing device 12 includes a driving roller 12*a*, and a fixing roller 12*c* built in with a heater 12*b*. Heat and pressure are applied to the recording material P passing through a fixing nip portion 16 formed between the fixing roller 12*c* and the driving roller 12*a* to fix the transferred toner image to the recording material P. Subsequently, the recording material P is conveyed with a pair of discharge rollers 13 and is discharged to a discharge tray 14.

Configuration of Process Cartridge

Figure 2:
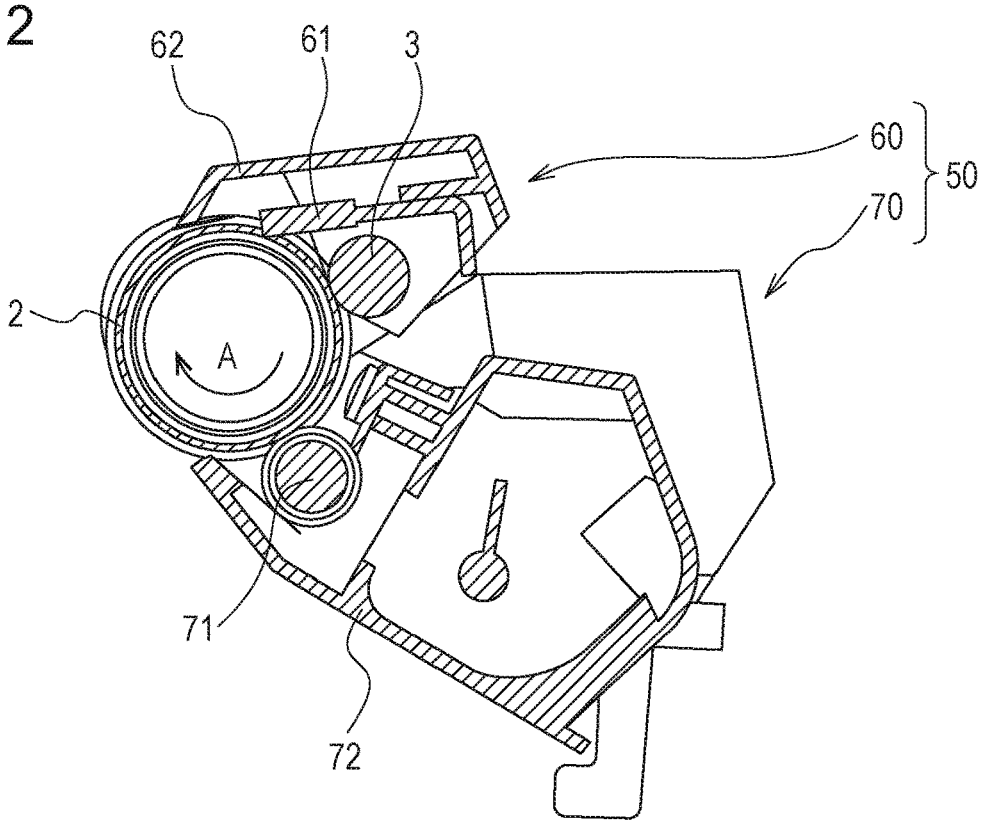
FIG. 2 is a cross-sectional view of an example process cartridge.
Figure 3:
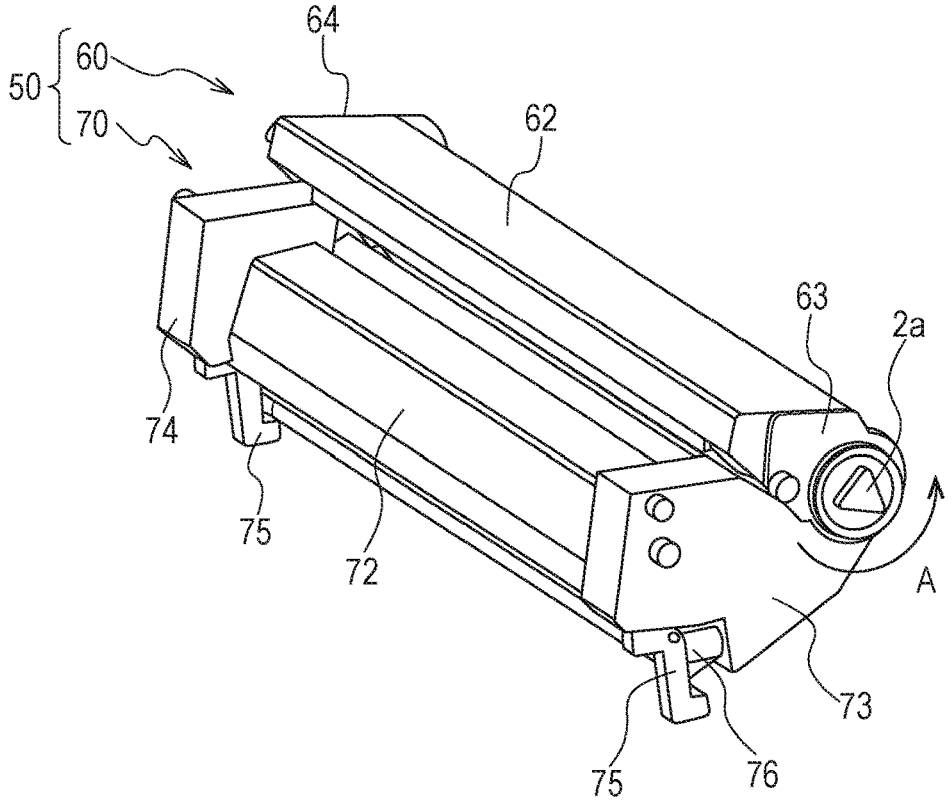
FIG. 3 is a perspective view of the process cartridge.

Referring next to FIGS. 2 and 3, the process cartridge 50, which is detachably attachable to the apparatus main body 1A of the image forming apparatus 1 of the present example embodiment, will be described. FIG. 2 is a cross-sectional view illustrating a configuration of the process cartridge 50.

As illustrated in FIG. 2, the process cartridge 50 includes the drum cartridge 60 including the photosensitive drum 2, the charge roller 3, and a cleaning blade 61, and the development cartridge 70 including the development roller 71. The drum cartridge 60 and the developing cartridge 70 are each separately detachably attachable to the apparatus main body 1A.

FIG. 3 illustrates a perspective view of the process cartridge 50. The photosensitive drum 2 is attached in a rotatable manner to a cleaning frame 62 of the drum cartridge 60 through a drive-side drum bearing 63 and a nondrive-side drum bearing 64. A drive input portion 2*a* provided in a longitudinally drive-side end portion of the photosensitive drum 2 engages with a drive output portion (not shown) of the apparatus main body 1A, and receives driving force of a drive source (not shown) to the apparatus main body 1A. With the above, the photosensitive drum 2 is rotationally driven in the arrow A direction in accordance with the image forming operation. Note that in the present example embodiment, the drive input portion 2*a* has a shape of a triangular prism twisted slightly; however, the shape thereof is not limited to such a shape.

A development frame member (a developing frame) 72 of the developing cartridge 70 includes a drive-side development-roller bearing 73 and a nondrive-side development-roller bearing 74. The development roller 71 is rotationally supported by the drive-side development-roller bearing 73 and the nondrive-side development-roller bearing 74. A pressed member 75 is attached to each of the drive-side development-roller bearing 73 and the nondrive-side development-roller bearing 74. Furthermore, pressurizing springs 76 that bias the pressed members 75 are each provided between the drive-side development-roller bearing 73 and the pressed member 75 and between the nondrive-side development-roller bearing 74 and the pressed member 75.

Configuration of Guiding Device of Process Cartridge

Figure 4:
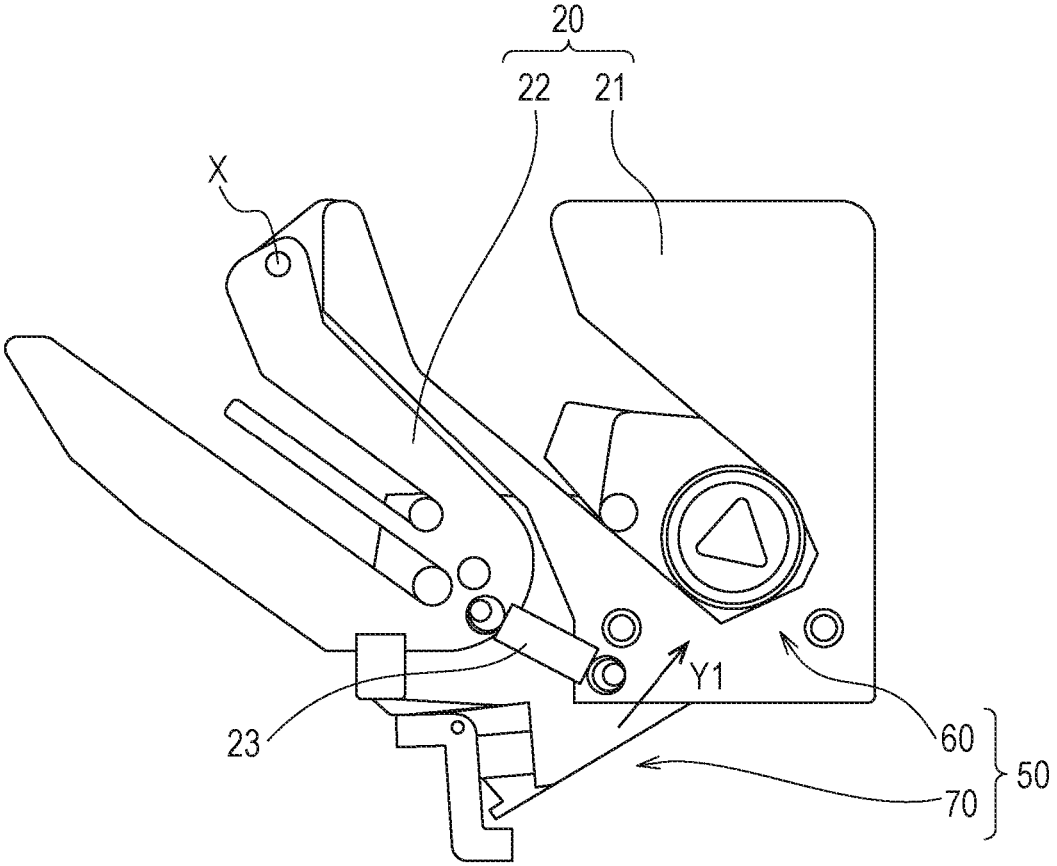
FIG. 4 is a diagram illustrating the process cartridge and a guide.

Referring next to FIG. 4, a configuration of a guiding device used when attaching and detaching the process cartridge 50 to and from the apparatus main body 1A will be described. Note that FIG. 4 is a side view of the process cartridge 50 and a cartridge guide 20 in a state in which the process cartridge 50 is mounted in the apparatus main body 1A. The cartridge guides 20 that are guiding devices that guide the process cartridge 50 are provided in the apparatus main body 1A so as to oppose each other at the drive side and the nondrive side. While FIG. 4 illustrates the drive-side cartridge guide 20, since the cartridge guides 20 are provided so as to have similar configurations on the drive side and the nondrive side in a symmetrical manner, detailed description of the nondrive-side cartridge guide 20 will be omitted.

As described above, the process cartridge 50 includes the drum cartridge 60 and the developing cartridge 70. As illustrated in FIG. 4, the cartridge guides 20 that serve as guiding devices when the process cartridge 50 is mounted inside the apparatus main body 1A are provided in the apparatus main body 1A. The cartridge guides 20 are provided inside the apparatus main body 1A on the drive side and on the nondrive side. Moreover, the cartridge guides 20 are each divided into a fixed guide 21 and a movable guide 22. The fixed guides 21 are fixed inside the apparatus main body 1A and serve as guiding devices when the drum cartridge 60 is mounted inside the apparatus main body 1A. The movable guide 22 are supported by the fixed guides 21 in a rotatable manner about a rotational axis X and serve as guiding devices when the developing cartridge 70 is mounted inside the apparatus main body 1A.

Furthermore, as illustrated in FIG. 4, a guide spring 23 is provided between the fixed guide 21 and the movable guide 22 of each cartridge guide 20. The guide springs 23 biases the fixed guides 21 to the movable guides 22. The developing cartridge 70 and the movable guides 22 are pivoted about the rotational axis X in a photosensitive drum direction Y1 with the guide springs 23 so as to be biased against the photosensitive drum 2. Accordingly, when in a state in which the drum cartridge 60 is mounted in the fixed guide 21 and the developing cartridge 70 is mounted in the movable guide 22, the development frame member 72 is rotatable relative to the photosensitive drum 2. Furthermore, in a state in which the developing cartridge 70 is not mounted as well, the movable guides 22 are pivoted about the rotational axis X in the photosensitive drum direction Y1 and is biased by the guide springs 23.

Abutting and Separating Configuration of Process Cartridge

Figure 5A:
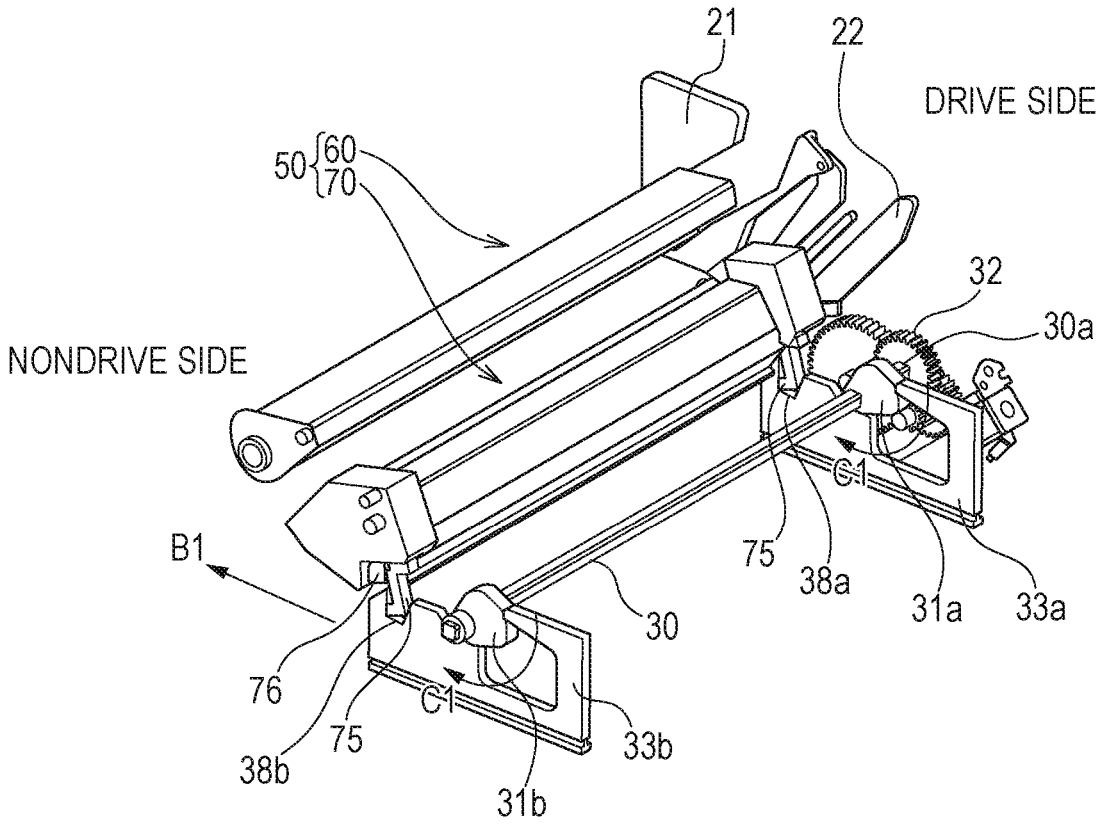
FIG. 5A is a perspective view of a developing, abutting, and separating configuration.
Figure 5B:
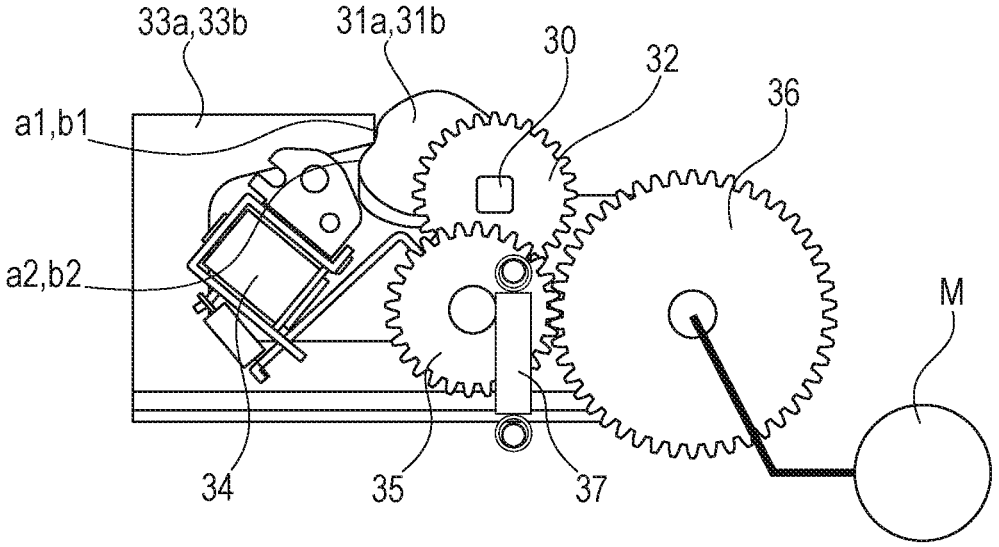
FIG. 5B is a side view of the developing, abutting, and separating configuration.

An abutting and separating configuration of the photosensitive drum 2 and the development roller 71 of the process cartridge 50 will be described next. In the image forming apparatus 1, the photosensitive drum 2 and the development roller 71 are abutted against each other only when an image is formed on the recording material P and other than that, the photosensitive drum 2 and the development roller 71 are separated from each other. A configuration changing the position of the development roller 71 with respect to the photosensitive drum 2 to perform an abutment and separation operation is illustrated in FIGS. 5A and 5B. FIG. 5A illustrates a state in which the drum cartridge 60 is mounted in the fixed guide 21, and the developing cartridge 70 is mounted in the movable guide 22. FIG. 5A is a perspective view illustrating a separated state of the process cartridge 50 in the abutting and separating configuration, and FIG. 5B is a diagram of the separated state of the process cartridge 50 in the abutting and separating configuration viewed in a rotational axis direction of the cam shaft 30 from the drive side towards the nondrive side.

As illustrated in FIG. 5A, the cam shaft (shaft) 30 is rotationally provided in the apparatus main body 1A, and a gear 32 is attached to a gear engagement portion 30*a* at a first end portion of the cam shaft 30. For the sake of description, in the rotational axis direction of the cam shaft 30, a first end side is referred to as a drive side (DS), and a second end side is referred to as a nondrive side (NS). The rotational axis direction of the cam shaft 30 is parallel to a rotational axis of the development roller 71 of the developing cartridge 70 mounted in the apparatus main body 1A and to a rotational axis of the photosensitive drum 2 of the drum cartridge 60 mounted in the apparatus main body 1A.

The gear engagement portion 30*a* of the cam shaft 30 is the drive input portion that is where driving force transmitted from a motor M (described later, see FIG. 5B) is input to the cam shaft 30 through the gear 32. A DS cam (a first cam) 31*a* and an NS cam (a second cam) 31*b* are fixed to the cam shaft 30 at positions that correspond to the two pressed members 75 attached to the two end portions of the developing cartridge 70. In the rotational axis direction of the cam shaft 30, the NS cam 31*b* is disposed at a position that is farther away from the gear engagement portion 30*a* than the DS cam 31*a*. Note that the DS cam 31*a* and the NS cam 31*b* will be referred to as cams 31*a* and 31*b* when referred collectively.

Furthermore, a DS slider (a first cam follower) 33*a* and an NS slider (a second cam follower) 33*b* are provided in the apparatus main body 1A at positions corresponding to the two pressed members 75 so as to be movable in a parallel manner in a B1 direction. Note that the DS slider 33*a* and the NS slider 33*b* are referred to as sliders 31*a* and 31*b* when referred collectively. The two pressed members 75 of the developing cartridge 70 mounted in the apparatus main body 1A are engaged to recesses 38*a* and 38*b* of the DS slider 33*a* and the NS slider 33*b*, and the abutment and separation operation of the developing cartridge 70 can be performed by moving the sliders 33*a* and 33*b* horizontally. Furthermore, the DS slider 33*a* and the NS slider 33*b* interlocking with the rotational movements of the DS cam 31*a* and the NS cam 31*b* in an arrow C1 direction move parallelly in the B1 direction.

Figure 9A:
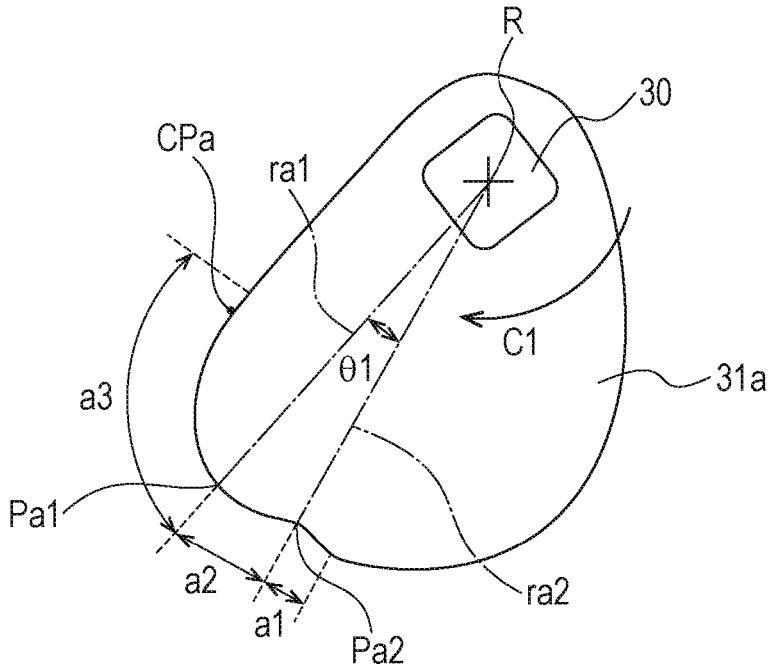
FIG. 9A is a side view of a DS cam.
Figure 9B:
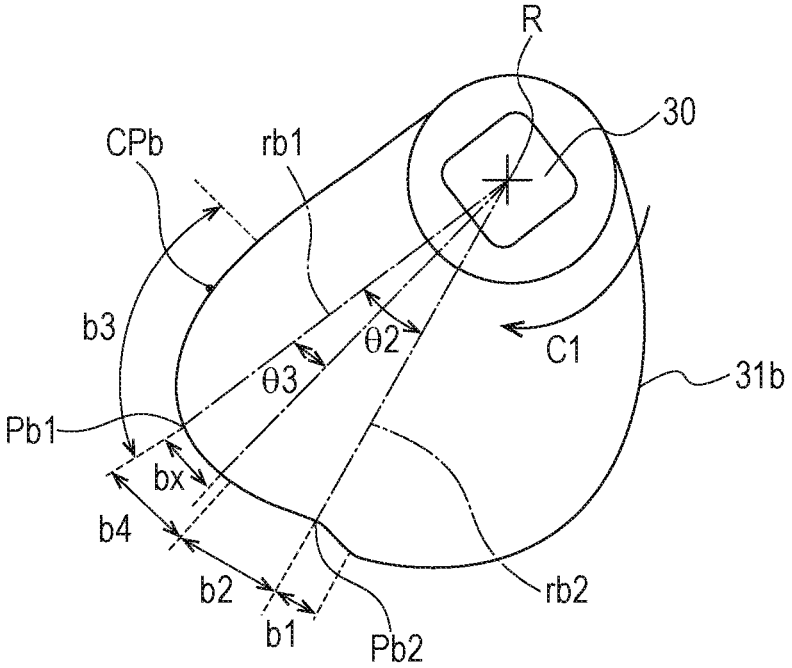
FIG. 9B is a side view of an NS cam.
Figure 10:
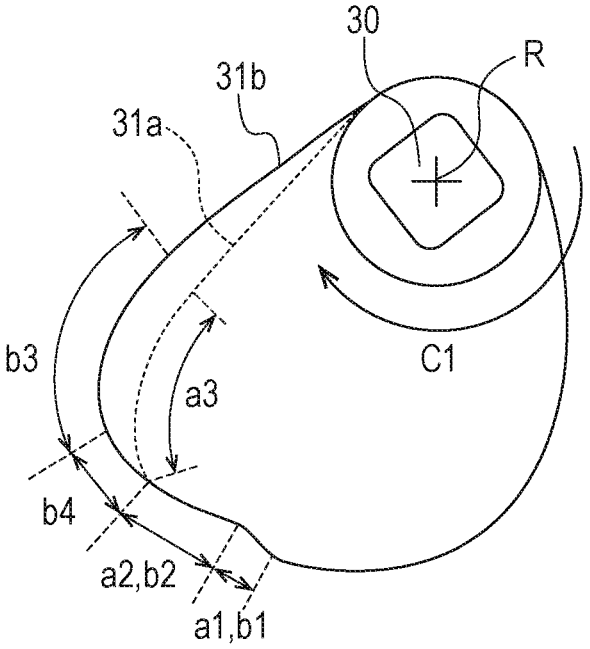
FIG. 10 is a side view of the DS cam and the NS cam.

Shapes (profiles of cam surfaces) of the cams 31*a* and 31*b* will be described next. FIG. 9A is a diagram of the DS cam 31*a* viewed in a direction of a rotational axis R of the cam shaft 30, and FIG. 9B is a diagram of the NS cam 31*b* viewed in a rotational axis R direction of the cam shaft 30. FIG. 10 is a diagram illustrating the DS cam 31*a* and the NS cam 31*b* in an overlapped state in the rotational axis R direction of the cam shaft 30. For the sake of description, the DS cam 31*a* is illustrated by a broken line and the NS cam 31*b* is illustrated by a solid line.

A peripheral surface of the DS cam 31*a* includes an area that comes into contact with the DS slider 33*a*. The area that comes into contact with the DS slider 33*a* includes a radius increased area a3, a radius decreased area a2, and a rotation stop area a1, which are arranged side by side in the above order from the downstream side towards the upstream side in a C1 direction in which the DS cam 31*a* rotates. A peripheral surface of the NS cam 31*b* includes an area that comes into contact with the NS slider 33*b*. The area that comes into contact with the NS slider 33*b* includes a radius increased area b3, a radius uniform area b4, a radius decreased area b2, and a rotation stop area b1, which are arranged side by side in the above order from the downstream side towards the upstream side in a C1 direction in which the NS cam 31*b* rotates. The cams 31*a* and 31*b* rotate in the C1 direction with the rotation of the cam shaft 30. Accordingly, contact points CPa and CPb that are portions in the peripheral surfaces of the cams 31*a* and 31*b*, with which the sliders 33*a* and 33*b* come into contact, move along the peripheral surfaces of the cams 31*a* and 31*b* in a direction opposite to the C1 direction when the cams 31*a* and 31*b* rotate in the C1 direction. FIGS. 9A and 9B illustrate, as examples of the contact points CPa and CPb, states in which the contact points CPa and CPb are situated in the radius increased areas a3 and b3.

The radius increased areas a3 and b3 are areas in which the distances (radii to the cam surfaces) between the contact points CPa and CPb and the rotational axis (a rotation center) R increase as the cams 31*a* and 31*b* rotate in the C1 direction. When the contact points CPa and CPb are in the radius increased areas a3 and b3, the sliders 33*a* and 33*b* are biased towards the cams 31*a* and 31*b*. Accordingly, the radius increased areas a3 and b3 receive, from the sliders 33*a* and 33*b*, force (loads) that rotates the cams 31*a* and 31*b* in a direction opposite to a rotation direction C1.

The radius decreased areas a2 and b2 are areas in which the distances (the radii to the cam surfaces) between the contact points CPa and CPb and the rotational axis (the rotation center) R decrease as the cams 31*a* and 31*b* rotate in the C1 direction. When the contact points CPa and CPb are in the radius decreased area a2 and b2, since the sliders 33*a* and 33*b* are biased towards the cams 31*a* and 31*b*, the radius decreased area a2 and b2 receive, from the sliders 33*a* and 33*b*, force that rotates the cams 31*a* and 31*b* in the rotation direction C1.

The rotation stop areas a1 and b1 are areas that stop the rotations of the cams 31*a* and 31*b*. By having the sliders 33*a* and 33*b*, which are biased towards the cams 31*a* and 31*b*, contact both the radius decreased areas a2 and b2 and the rotation stop areas a1 and b1, the rotations of the cams 31*a* and 31*b* relative to the sliders 33*a* and 33*b* in the C1 direction and the direction opposite to the C1 direction are restricted. The above state is a state in which the cams 31*a* and 31*b* are at home positions (stop positions), and is a state in which the contact points CPa and CPb are situated in the rotation stop areas a1 and b1 and in the radius decreased areas a2 and b2, and the cams 31*a* and 31*b* and the sliders 33*a* and 33*b* engage with each other. The radius uniform area b4 is an area that is provided on the peripheral surface of the NS cam 31*b* and between the radius increased area b3 and the radius decreased area b2 in the rotation direction C1. The radius uniform area b4 is an area in which the distance (the radius to the cam surface) between a contact point CPb and the rotational axis (the rotation center) R is practically uniform (does not change) with the rotation of the NS cam 31*b* in the C1 direction.

As illustrated in FIG. 10, in a state (a natural state) in which the cam shaft 30 is not twisted, the DS cam 31*a* and the NS cam 31*b* are fixed to the cam shaft 30 so that the rotation stop area a1 and the rotation stop area b1 are in the same phase in the rotation direction C1. Accordingly, in the natural state, the radius increased area b3 of the NS cam 31*b* is disposed downstream of the radius increased area a3 of the DS cam 31*a* in the rotation direction C1 in proportion to the length of the radius uniform area b4.

Furthermore, in a state in which a contact point CPa to which the DS slider 33*a* is in contact is positioned at an upstream end portion (a boundary point between the radius increased area a3 and the radius decreased area a2) Pa1 of the radius increased area a3 in the direction C1 (the rotation direction), when the end portion is a starting point, θ1 is a rotation amount of the DS cam 31*a* needed for the slider 33*a* to contact the rotation stop area a1. In the present example embodiment, θ1 is an angle formed between a line segment ra1 connecting the boundary point Pa1 between the radius increased area a3 and the radius decreased area a2 and the rotational axis R, and a line segment ra2 connecting a boundary point Pa2 between the radius decreased area a2 and the rotation stop area a1 and the rotational axis R.

In a state in which a contact point CPb to which the NS slider 33*b* is in contact is positioned at an upstream end portion Pb1 (a boundary point between the radius increased area b3 and the radius uniform area b4) of the radius increased area b3 in the direction C1 (the rotation direction), when the boundary point is a starting point, θ2 is a rotation amount of the NS cam 31*b* needed for the slider 33*b* to contact the rotation stop area b1. In the present example embodiment, θ2 is an angle formed between a line segment rb1 connecting the boundary point Pb1 between the radius increased area b3 and the radius uniform area b4 and the rotational axis R, and a line segment rb2 connecting a boundary point Pb2 between the radius decreased area b2 and the rotation stop area b1 and the rotational axis R. Furthermore, the rotation amount θ2 is larger than the rotation amount θ1 (θ1<θ2).

Referring next to FIG. 5B, a drive structure of the cam shaft 30 to which the cams 31*a* and 31*b* are fixed will be described. The drive structure of the cam shaft 30 includes the gear 32 attached to the cam shaft 30, a partially-toothless gear 35 that transmits driving force to the gear 32, and a driving gear 36 that receives driving force from the motor M serving as a drive source and that transmits the driving force to the partially-toothless gear 35. The partially-toothless gear 35 is a two-step gear including a gear portion that meshes with the driving gear and a gear portion that meshes with the gear 32. When the partially-toothless gear 35 rotates a single turn, the gear 32 rotates half a turn. In other words, the gear ratio between the partially-toothless gear 35 and the gear 32 is 1:2. Furthermore, the partially-toothless gear 35 and the apparatus main body 1A are connected to each other through a partially-toothless gear spring 37. A solenoid 34 provided on the apparatus main body 1A engages with the partially-toothless gear 35. When the solenoid 34 is operated, the partially-toothless gear 35 is meshed with the driving gear 36 with the partially-toothless gear spring 37 and is rotated one turn so that the gear 32 and the cam shaft 30 rotate half a turn in an integral manner.

When the cams 31*a* and 31*b* are in separated positions, the sliders 33*a* and 33*b* are in separated positions, and the development roller 71 is separated from the photosensitive drum 2. When the cams 31*a* and 31*b* are in contact positions, the sliders 33*a* and 33*b* are in contact positions, and the development roller 71 is abutted against the photosensitive drum 2 and is urged against the photosensitive drum 2 at a desired pressure. When the cams 31*a* and 31*b* are in the separated positions and in the contact positions, the toothless portion of the partially-toothless gear 35 opposes the driving gear 36, and the partially-toothless gear 35 is not meshed with the driving gear 36. Accordingly, a state in which there is no drive transmitted between the partially-toothless gear 35 and the driving gear 36 is obtained (a state in which the drive is off is obtained). The above state is a state in which the cams 31*a* and 31*b* are in the home positions. In such a case, as described above, the cams 31*a* and 31*b* receiving force from the sliders 33*a* and 33*b* are positioned so that the contact points CPa and CPb are situated in the rotation stop areas a1 and b1 and the radius decreased areas a2 and b2, and so that the tips of the teeth of the partially-toothless gear 35 and those of the driving gear 36 do not contact each other.

Driving force is transmitted to both the cams 31*a* and 31*b* from a drive source M through a driving force transmission path including the driving gear 36, the partially-toothless gear 35, the gear 32, and the cam shaft 30. However, in the cam shaft 30, a portion between the gear 32 and the NS cam 31*b* is longer than a portion between the gear 32 and the DS cam 31*a*. Accordingly, the driving force transmission path from the gear 32 to the NS cam 31*b* is longer than the driving force transmission path from the gear 32 to the DS cam 31*a*. Due to the above difference in length between the driving force transmission paths, the driving force transmission path from the motor M to the NS cam 31*b* is longer than the driving force transmission path from the motor M to the DS cam 31*a*.

Abutment and Separation Operation of Process Cartridge

Figure 6A:
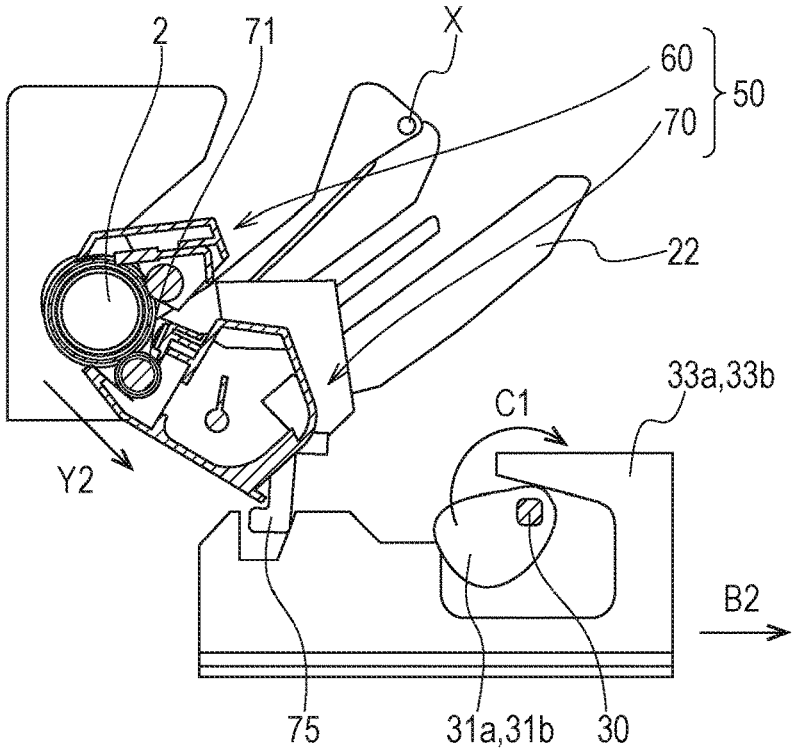
FIG. 6A is a diagram illustrating an operation of the developing, abutting, and separating configuration.
Figure 6B:
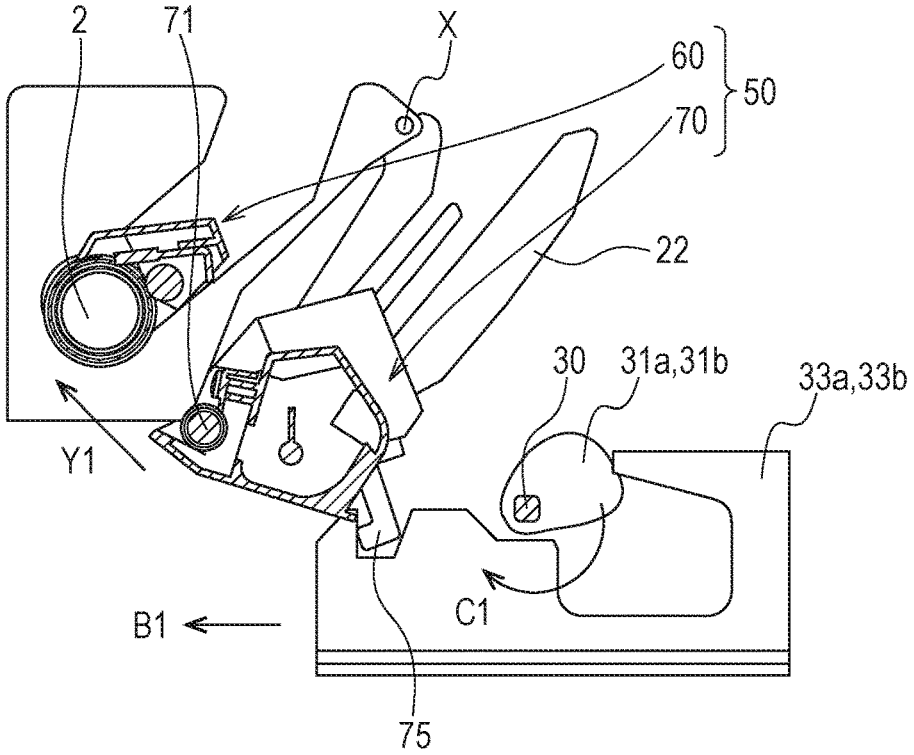
FIG. 6B is a diagram illustrating an operation of the developing, abutting, and separating configuration.

An abutment and separation operation of the photosensitive drum 2 and the development roller 71 of the process cartridge 50 will be described with reference to FIGS. 6A and 6B. FIG. 6A illustrates a contact state of the process cartridge 50. FIG. 6B illustrates a separated state of the process cartridge 50 and is a diagram of a can shaft 30 viewed in the rotational axis direction.

As illustrated in FIG. 6B, first, the image forming apparatus 1 is stopped in a state in which the photosensitive drum 2 and the development roller 71 are separated from each other. Subsequently, when a print start signal is input to the apparatus main body 1A, the solenoid 34 illustrated in FIG. 5B is operated, the partially-toothless gear 35 is meshed with the driving gear 36 with the partially-toothless gear spring 37, and the cam shaft 30 integral with the gear 32, and the cams 31*a* and 31*b* rotate in the C1 direction. When the cams 31*a* and 31*b* rotate in the C1 direction, the sliders 33*a* and 33*b* interlocked with the cams 31*a* and 31*b* move in an arrow B1 direction. Subsequently, the sliders 33*a* and 33*b* bias the pressed members 75 supported by the developing cartridge 70, and the biasing force is transmitted to the developing cartridge 70 through the pressurizing springs 76. By so doing, the developing cartridge 70 having received the biasing force pivots in a Y1 direction together with the movable guides 22 about the movable guide rotational axis X to abut the development roller 71 and the photosensitive drum 2 against each other. When the cams 31*a* and 31*b* rotate half a turn in the C1 direction and stop, the contact state of the process cartridge 50 illustrated in FIG. 6A is reached which allows a toner image to be formed on the photosensitive drum 2. In the above, the cams 31*a* and 31*b* stop at the contact position.

Subsequently, after the transfer of an image to the recording material P is completed, a print end signal is input to the apparatus main body 1A, the solenoid 34 illustrated in FIG. 5B is operated, and the partially-toothless gear 35 is meshed with the driving gear 36 with the partially-toothless gear spring 37. Subsequently, the cam shaft 30 integral with the gear 32 and the cams 31*a* and 31*b* rotate half a turn (turn 180°) in the C1 direction illustrated in FIG. 6A. When the cams 31*a* and 31*b* rotate half a turn in the C1 direction, the sliders 33*a* and 33*b* interlocked with the cams 31*a* and 31*b* move in an arrow B2 direction. Subsequently, the sliders 33*a* and 33*b* bias the pressed member 75 supported by the developing cartridge 70, the developing cartridge 70 and the movable guides 22 pivot in a Y2 direction about the movable guide rotational axis X, and the development roller 71 and the photosensitive drum 2 become separated from each other. When half a turn of the cams 31*a* and 31*b* in the C1 direction is completed, the separated state of the process cartridge 50 illustrated in FIG. 6B is reached, and the printing operation is completed. In the above, the cams 31*a* and 31*b* stop at the separated position.

As described above, the operation of transitioning from the separated state illustrated in FIG. 6B to the contact state illustrated in FIG. 6A is performed before the printing, and the operation of transitioning from the contact state illustrated in FIG. 6A to the separated state illustrated in FIG. 6B is performed after the printing. The above sequential operation is repeated each time a print job signal is input.

Elastic Deformation of Twisted Cam Shaft

Figure 7A:
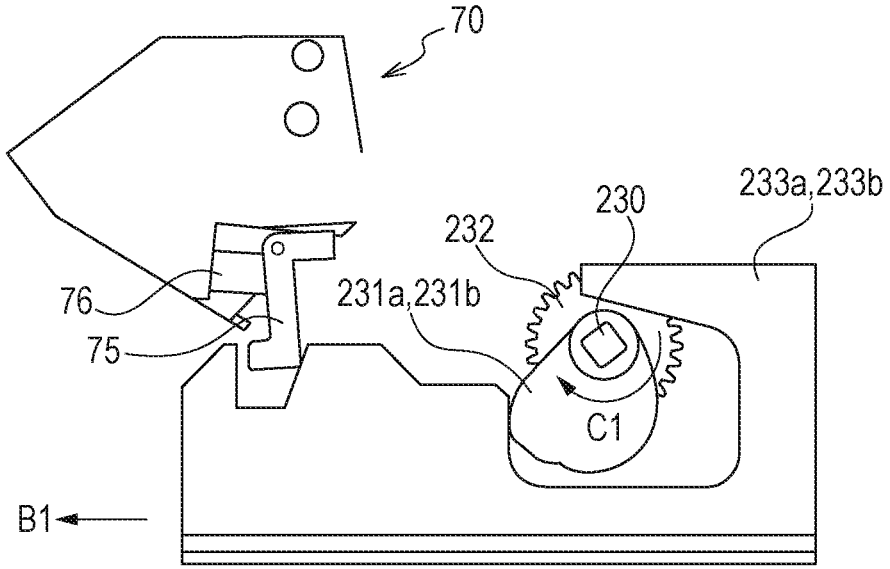
FIG. 7A is a side view of the developing, abutting, and separating configuration.
Figure 7B:
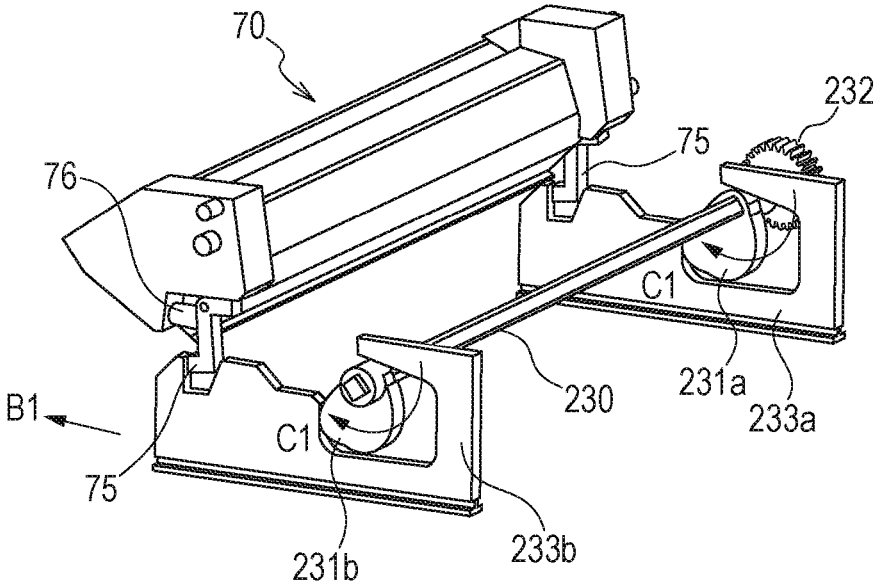
FIG. 7B is a perspective view of the developing, abutting, and separating configuration.
Figure 8:
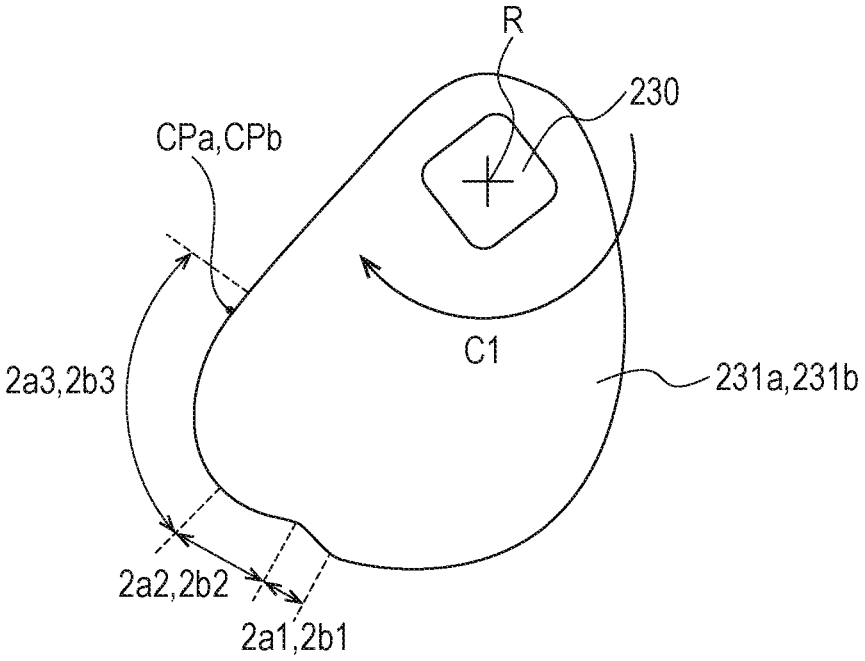
FIG. 8 is a side view of a cam.

When performing the abutment and separation operation on the process cartridge 50, since the sliders 33*a* and 33*b* receives a load (a resistance) from the developing cartridge 70 in a direction that is opposite to the moving direction, there are cases in which the cam shaft 30 becomes twisted and elastic deformed. Regarding such twisting and elastic deformation, twisting and elastic deformation of a cam shaft 230 occurring when the abutment and separation operation of the developing cartridge 70 is performed will be described using a conventional abutting and separating configuration. FIG. 7A is a diagram illustrating sliders 233*a* and 233*b* of the conventional art transitioning from a separated state to a contact state. FIG. 7B is a perspective view illustrating the twisting and elastic deformation of the cam shaft when the sliders 233*a* and 233*b* of the conventional art are moved. FIG. 8 is a diagram of cams 231*a* and 231*b* of the conventional art viewed in a rotational axis R direction.

As illustrated in FIG. 8, the DS cam 231*a* and the NS cam 231*b* have the same shape and have the same shape as the DS cam 31*a* of the present example embodiment. Accordingly, radius increased areas 2*a*3 and 2*b*3, radius decreased areas 2*a*2 and 2*b*2, rotation stop areas 2*a*1 and 2*b*1 of the DS cam 231*a* and the NS cam 231*b* have the same shapes as the radius increased area a3, the radius decreased area a2, and the rotation stop area a1 of the DS cam 31*a*, respectively.

Note that in the conventional art, the configuration and control other than those of the cams 231*a* and 231*b* described above are similar to the abutting and separating configuration of the present disclosure described above; accordingly, detailed description thereof is omitted.

As illustrated in FIG. 7A, in a case in which the sliders 233*a* and 233*b* perform movement for abutment in the B1 direction from the separated position towards the contact position, the sliders 233*a* and 233*b* are biased in a direction opposite to the B1 direction with a pressurizing spring 276 of a developing cartridge 270. Accordingly, when the radius increased areas 2*a*3 and 2*b*3 come into contact with the sliders 233*a* and 233*b*, the radius increased areas 2*a*3 and 2*b*3 receive loads that resist the rotation of the cams 231*a* and 231*b* in the C1 direction.

There are cases in which the cam shaft 230 becomes twisted and elastically deformed, depending on the torsional rigidity of the cam shaft 230. Note that as illustrated in FIG. 7B, the NS cam 231*b* is farther away from a gear 232 than the DS cam 231*a* in the rotational axis direction of the cam shaft 230, and the NS cam 231*b* has a driving force transmission path from the gear 232 that is longer than that of the DS cam 231*a*. Accordingly, the NS cam 231*b* is more effected by the twisting of the cam shaft 230 than the DS cam 231*a* and, accordingly, the driving force from the gear 232 is not easily transmitted to the NS cam 231*b*. As a result, the rotation of the NS cam 231*b* is delayed with respect to the rotation of the DS cam 231*a*.

Furthermore, even in a case in which the sliders 233*a* and 233*b* perform movement for separation in the B2 direction from the contact position towards the separated position, the sliders 233*a* and 233*b* are biased to a direction (the B1 direction) opposite to the B2 direction with the guide springs 223 attached to the movable guides 222. Accordingly, when the radius increased areas 2*a*3 and 2*b*3 come into contact with the sliders 233*a* and 233*b*, the radius increased areas 2*a*3 and 2*b*3 receive loads that resist the rotation of the cams 231*a* and 231*b* in the C1 direction, and similar to the movement for abutment, twisting and elastic deformation occurs in the cam shaft 230.

Since the shapes of the DS cam 231*a* and the NS cam 231*b* are the same, and the attached phases with respect to the cam shaft 230 are the same, when the cams 231*a* and 231*b* receive loads and the cam shaft 230 becomes twisted, unconformity occurs between the movement of the DS slider 233*a* and that of the NS slider 233*b*. Specifically, the NS cam 231*b* that is father away from the gear 232 becomes delayed relative to the DS cam 231*a* and, due to that, the NS slider 233*b* becomes delayed relative to the DS slider 233*a*. In some cases, there will be a concern that the NS cam 231*b* may not be able to reach the home position although the DS cam 231*a* has reached the home position, due to the twisting of the cam shaft 230 not being released and the contact point CPb not passing through the radius increased area 2*b*3.

Furthermore, even if the NS slider 233*b* were to reach the home position, there is a concern that the following phenomenon may occur. That is, in a state in which the contact point CPb is situated in the radius decreased area 2*b*2 and the NS cam 230*b* is receiving C1 direction rotating force, the twist of the cam shaft 230 may be released. In such a case, in addition to the force from the NS slider 233*b* in contact with the radius decreased area 2*b*2, restorative force that releases the twist of the cam shaft 230 is received; accordingly, the rotation speed of the NS cam 231*b* in the C1 direction is increased significantly. Furthermore, the impinging sound generated when the NS slider 233*b* comes into contact with the rotation stop area 2*a*1 of the NS cam 231*b* with increased speed may increase and the operation sound of the NS cam 231*b* may increase. As described above, when the timing at which the twisting of the cam shaft 230 is released and the timing at which the NS slider 233*b* comes into contact with the rotation stop area 2*a*1 coincides each other, the impinging sound when the NS slider 233*b* comes into contact becomes large and the quietness of the image forming apparatus 1 may become compromised.

Movements of Cams 31*a* and 31*b* During Abutting Operation

Movements of the cams 31*a* and 31*b* moving from the separated position to the contact position when the process cartridge 50 is transitioned from the separated state to the contact state will be described next. FIGS. 13A to 13C and FIGS. 14A and 14B are diagrams of portions of the cams 31*a* and 31*b* and the sliders 33*a* and 33*b* when viewed in the rotational axis R direction. For the sake of description, the cam 31*a* is depicted by a broken line and the cam 31*b* is depicted by a solid line.

Figure 13A:
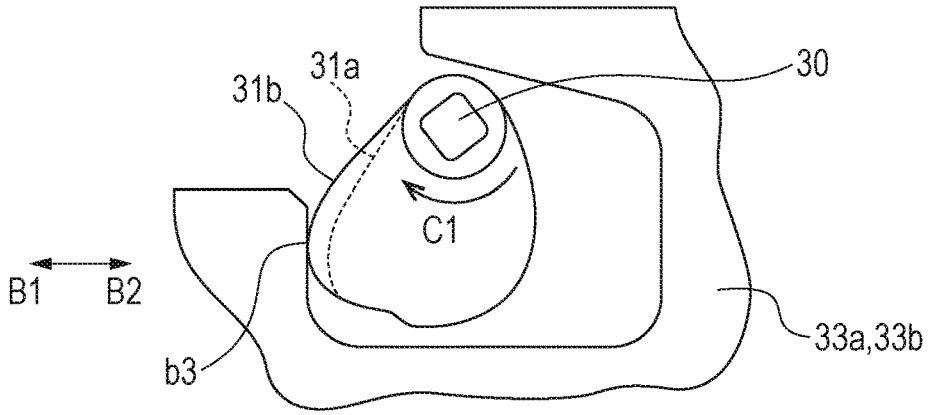
FIG. 13A is a diagram illustrating a relationship between a cam and a slider.

When the cam shaft 30 is rotated about 130° in the C1 direction from the separated state illustrated in FIG. 6B, a state illustrated in FIG. 13A is reached in which the radius increased area b3 of the NS cam 31*b* starts to come in contact with the NS slider 33*b*. As described above, in the natural state, the radius increased area b3 of the NS cam 31*b* is disposed downstream of the radius increased area a3 of the DS cam 31*a* in the rotation direction C1 in proportion to the length of the radius uniform area b4. Accordingly, in the above state, the DS cam 31*a* is not in contact with the DS slider 33*a*, and the cam shaft 30 is not twisted.

Figure 13B:
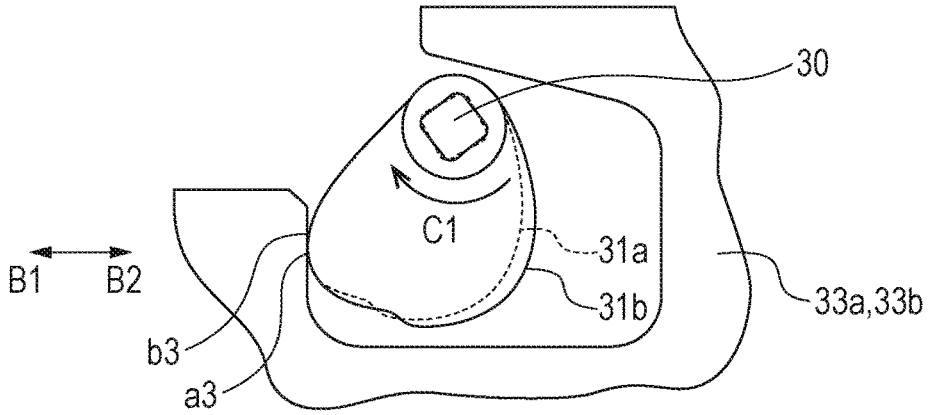
FIG. 13B is a diagram illustrating a relationship between a cam and a slider.

Furthermore, when the cam shaft 30 is rotated in the C1 direction, as illustrated in FIG. 13B, a state is reached in which the radius increased area a3 of the DS cam 31*a* starts to come in contact with the DS slider 33*a*. In other words, the clock time (first timing) at which the radius increased area a3 of the DS cam 31*a* starts to come in contact with the DS slider 33*a* is later than the clock time (second timing) at which the radius increased area b3 of the NS cam 31*b* starts to come in contact with the NS slider 33*b*. When the NS cam 31*b* is further rotated in the C1 direction after the radius increased area b3 has come into contact with the NS slider 33*b*, the NS cam 31*b* attempts to move the NS slider 33*b* in the B1 direction. However, since the NS slider 33*b* receives biasing force from the developing cartridge 70 in the B2 direction, owing to the biasing force, the NS cam 31*b* receives a load that obstructs the rotation in the C1 direction. By being affected by the above loads, the cam shaft 30 is twisted in an elastically deformed manner to the degree that the radius increased area a3 of the DS cam 31*a* comes into contact with the DS slider 33*a* such that, compared with the natural state, the phase of the NS cam 31*b* is deviated towards the upstream side with respect to the DS cam 31*a* in the C1 direction. Accordingly, in the state illustrated in FIG. 13B, the cam shaft 30 is twisted.

Figure 13C:
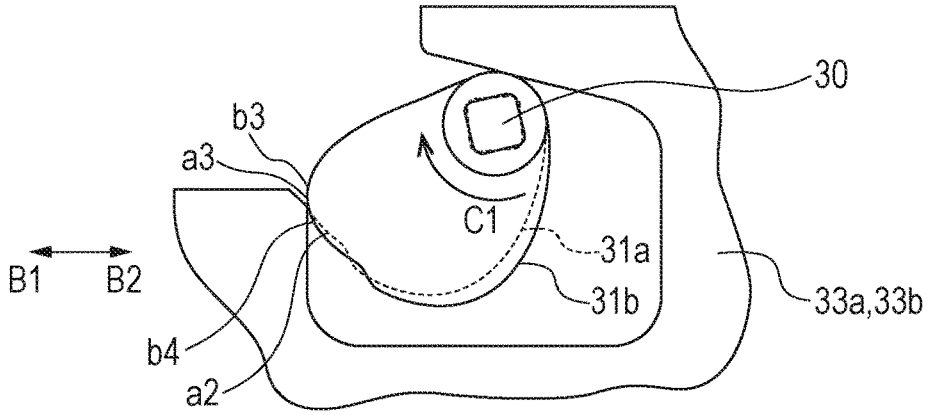
FIG. 13C is a diagram illustrating a relationship between a cam and a slider.

When the cam shaft 30 further rotates in the C1 direction from the state illustrated in FIG. 13B, the cam shaft 30 rotates in the C1 direction while maintaining the balance between the restorative force that returns the twisted cam shaft 30 to the natural state and the load that the NS cam 31*b* receives. In due time, as illustrated in FIG. 13C, the contact point of the NS cam 31*b* in contact with the NS slider 33*b* reaches the boundary between the radius increased area b3 and the radius uniform area b4. In the above moment, while the twisted amount of the cam shaft 30 is maintained at a constant amount, the contact point of the DS cam 31*a* in contact with the DS slider 33*a* is situated immediately before the boundary between the radius increased area a3 and the radius decreased area a2.

Subsequently, when the contact point of the NS cam 31*b* in contact with the NS slider 33*b* enters the radius uniform area b4, the load exerted in the direction that obstructs the rotation towards the C1 direction and that is, from the NS slider 33*b*, received by the NS cam 31*b* becomes smaller; accordingly, the twist of the cam shaft 30 is substantially released by the restorative force. The above state is the state illustrated in FIG. 14A, and is a state in which the contact point of the NS cam 31*b* in contact with the NS slider has reached the boundary between the radius uniform area b4 and the radius decreased area b2. Furthermore, the contact point of the DS cam 31*a* in contact with the DS slider 33*a* is at the boundary between the radius increased area a3 and the radius decreased area a2.

From the above state, when the cam shaft 30 rotates further in the C1 direction, the contact point of the NS cam 31*b* in contact with the NS slider 33*b* moves to the radius decreased area b2, and the contact point of the DS cam 31*a* in contact with the DS slider 33*a* moves to the radius decreased area a2. The DS slider 33*a* and the NS slider 33*b* receive biasing force in the B2 direction from the developing cartridge 70; accordingly, the biasing force becomes the pressing force that presses the NS cam 31*b* and the DS cam 31*a*. Furthermore, the above pressing force includes a force (rotary force) component that acts on the NS cam 31*b* and the DS cam 31*a* so that the NS cam 31*b* and the DS cam 31*a* are rotated in the C1 direction.

Figure 14A:
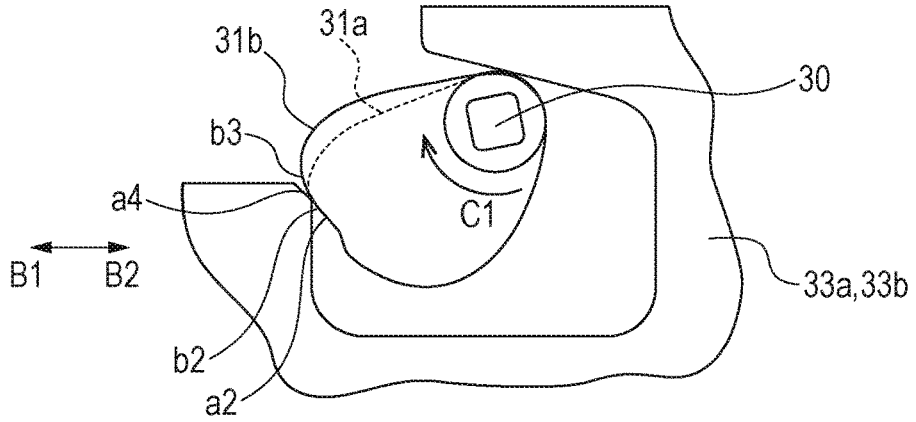
FIG. 14A is a diagram illustrating a relationship between a cam and a slider.
Figure 14B:
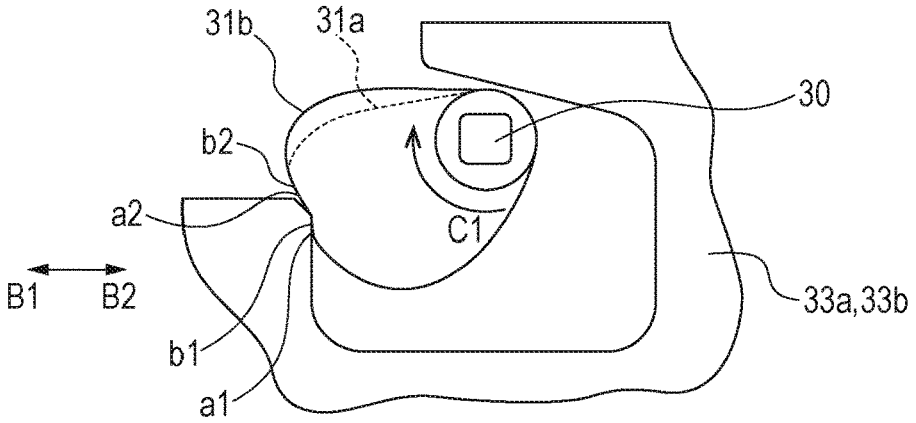
FIG. 14B is a diagram illustrating a relationship between a cam and a slider.

When the NS slider 33*b* is in contact with the radius decreased area b2 and the DS slider 33*a* is in contact with the radius decreased area a2, the toothless portion of the partially-toothless gear 35 rotates to a position opposing the gear 36 so that the cam shaft 30 cannot receive rotary force from the gear 32 in the C1 direction. However, the NS cam 31*b* and the DS cam 31*a* are rotated in the C1 direction with the rotary force from the DS slider 33*a* and the NS slider 33*b*. As a result, as illustrated in FIG. 14B, the NS slider 33*b* comes in contact with the rotation stop area b1 of the NS cam 31*b*, and the DS slider 33*a* comes in contact with the rotation stop area a1 of the DS cam 31*a*; accordingly, the rotations are stopped. In so doing, the NS slider 33*b* also comes in contact with the radius decreased area b2 of the NS cam 31*b*, and the DS slider 33*a* also comes in contact with the radius decreased area a2 of the DS cam 31*a*; accordingly, the NS cam 31*b* and the DS cam 31*a* are positioned at the above positions. The NS cam 31*b* and the DS cam 31*a* are positioned in the contact positions (the home positions) in the above manner, and the process cartridge 50 is maintained in the contact state. The clock time (third timing) at which the DS slider 33*a* comes in contact with the rotation stop area a1 of the DS cam 31*a* and the clock time (fourth timing) at which the NS slider 33*b* comes in contact with the rotation stop area b1 of the NS cam 31*b* are the same. However, as long as the time difference (absolute value) between the third timing and the fourth timing is shorter than the time difference (absolute value) between the first timing and the second timing described above, the third timing and the fourth timing do not have to be the same.

The movements of the cams 31*a* and 31*b* moving from the contact position to the separated position when the operation process cartridge 50 is transitioned from the contact state to the separated state is a movement similar to that described above; accordingly, description thereof is omitted.

As described above, in the present example embodiment, the radius decreased area a2 is provided adjacent to the radius increased area a3 in the C1 direction and on the peripheral surface of the DS cam 31*a* and, meanwhile, the radius uniform area b4 is provided between the radius increased area b3 and the radius decreased area b2 in the C1 direction and on the peripheral surface of the NS cam 31*b*. With the above, the rotation amount θ2 is set larger than the rotation amount θ1 (θ1<θ2). Accordingly, after passing through the radius increased area b3, when the contact point CPb of the NS cam 31*b* in contact with the NS slider 33*b* enters the radius uniform area b4, the twist of the cam shaft 30 becomes substantially released.

In a state in which the contact point CPb is at the upstream end portion Pb1 of the radius increased area b3 in the C1 direction, when the end portion is the starting point, the rotation amount of the NS cam 31*b* needed to substantially release the twist of the cam shaft 30 is denoted as θ3. In the peripheral surface of the NS cam 31*b*, an area from the upstream end portion Pb1, serving as a starting point, to where the contact point CPb comes in contact after moving rotation amount θ3 in the C1 direction is referred to as a twist releasing area bx. Regarding the distance in which the contact point CPb moves on the peripheral surface of the NS cam 31*b*, the distance of the radius uniform area b4 is set so that the distance of the twist releasing area bx is the same or shorter than the distance of the radius uniform area b4.

Accordingly, the twist of the cam shaft 30 is substantially released when the contact point of the NS cam 31*b* in contact with the NS slider 33*b* is situated in the radius uniform area b4 and, subsequently, the contact point of the DS cam 31*a* in contact with the DS slider 33*a* reaches the radius decreased area a2. Accordingly, situations such as the DS cam 31*a* reaching the home position before the twist of the cam shaft 30 is released and the NS cam 31*b* not being able to reach the home position can be prevented.

Furthermore, the contact point of the NS cam 31*b* in contact with the NS slider 33*b* reaches the radius decreased area b2 after the twist of the cam shaft 30 has been substantially released. Accordingly, when the NS cam 31*b* is rotating in the C1 direction while the NS slider 33*b* is in contact with the radius decreased area b2, there will be no increase in the speed of the NS cam 31*b* due to the release of the twist of the cam shaft 30. Accordingly, an increase in the impinging sound when the NS slider 33*b* comes in contact with the rotation stop area b1 of the NS cam 31*b* can be suppressed, and the decrease in the quietness of the image forming apparatus 1 can be suppressed.

Second Example Embodiment

Figure 11:
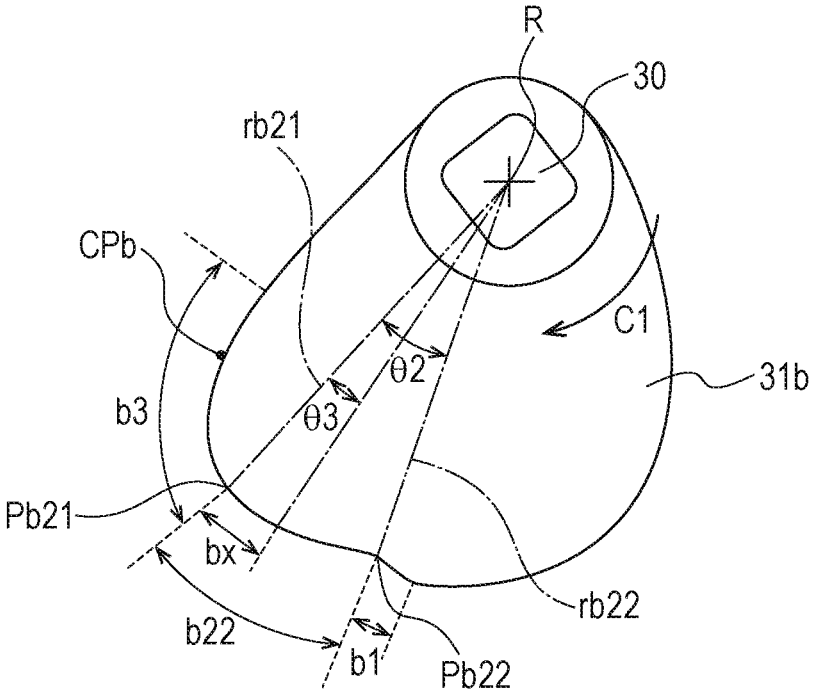
FIG. 11 is a side view of the NS cam.

Description of a second example embodiment will be given next. In the second example embodiment, a modification example of the cam shape of the NS cam 31*b* will be described. FIG. 11 is a diagram illustrating a shape of the NS cam 31*b*, and is a diagram viewed in the rotational axis R direction. FIG. 11 illustrates, as an example of the contact point CPb, a state in which the contact point CPb is situated in the radius increased area b3.

In the first example embodiment described above, the peripheral surface of the NS cam 31*b* is provided with the radius increased area b3, the radius uniform area b4, the radius decreased area b2, and the rotation stop area b1. In the NS cam 31*b* of the present example embodiment, as illustrated in FIG. 11, the portions in the first example embodiment where the radius uniform area b4 and the radius decreased area b2 are provided is a radius decreased area b22. In other words, in the peripheral surface of the NS cam 31*b*, the radius decreased area b22 is disposed adjacent to the radius increased area b3 in the C1 direction. Other configurations are the same as those of the first example embodiment; accordingly, description thereof is omitted.

In a state in which the contact point CPb is situated at a boundary point Pb21 between the radius increased area b3 and the radius decreased area b22, when the boundary point is a starting point, θ2 is a rotation amount of the NS cam 31*b* needed for the slider 33*b* to contact the rotation stop area b1. θ2 is an angle formed between a line segment rb21 connecting the boundary point Pb21 between the radius increased area b3 and the radius decreased area b22 and the rotational axis R, and a line segment rb22 connecting a boundary point Pb22 between the radius decreased area b22 and the rotation stop area b1 and the rotational axis R. Furthermore, the rotation amount θ2 is larger than the rotation amount θ1 (θ1<θ2). In other words, regarding the distances along the peripheral surfaces of the cams 31*a* and 31*b*, the radius decreased area b22 is longer than the radius decreased area a2.

Accordingly, after passing through the radius increased area b3, when the contact point CPb of the NS cam 31*b* in contact with the NS slider 33*b* enters the radius decreased area b22, the twist of the cam shaft 30 becomes substantially released. In a state in which the contact point CPb is at the upstream end portion Pb21 of the radius increased area b3 in the C1 direction, when the end portion is starting point, the rotation amount of the NS cam 31*b* needed to substantially release the twist of the cam shaft 30 is denoted as θ3. Then, the rotation amount θ2 is set so that the rotation amount θ2 is larger than the rotation amount θ3 (θ3<θ2). In the peripheral surface of the NS cam 31*b*, an area from the upstream end portion Pb21, serving as a starting point, to where the contact point CPb comes in contact after moving rotation amount θ3 in the C1 direction is referred to as the twist releasing area bx. By providing the twist releasing area bx in the radius decreased area b22 in the above manner, the NS cam 31*b* receives, from the NS slider 33*b*, force in the direction releasing the twist of the cam shaft 30; accordingly, the twist of the cam shaft 30 can be released in a more reliable manner.

Note that the rotation amount θ2 in the present example embodiment is set to have the same value as the rotation amount θ2 of the first example embodiment; however, the rotation amount θ2 may be any value that satisfies θ1<θ2 and θ3<θ2 described above.

As described above, in the present example embodiment, the radius decreased area a2 is provided adjacent to the radius increased area a3 in the C1 direction and on the peripheral surface of the DS cam 31*a*, and the radius decreased area b22 is provided adjacent to the radius increased area b3 in the C1 direction and on the peripheral surface of the NS cam 31*b*. Furthermore, the shapes of the radius decreased area a2 and the radius decreased area b22 are set so that the rotation amount θ2 is larger than the rotation amount θ1 (θ1<θ2).

Accordingly, after passing through the radius increased area b3, when the contact point CPb enters the radius decreased area b22, the twist of the cam shaft 30 becomes substantially released in the twist releasing area bx. Subsequently, the contact point of the DS cam 31*a* in contact with the DS slider 33*a* can be made to reach the radius decreased area a2. Accordingly, situations such as the DS cam 31*a* reaching the home position before the twist of the cam shaft 30 is released and the NS cam 31*b* not being able to reach the home position can be prevented.

Furthermore, even after the contact point CPb passes through the twist releasing area bx, the radius decreased area b22 continues. Accordingly, after the contact point CPb has passed through the twist releasing area bx, when the contact point CPb is situated in the radius decreased area b22, there will be no increase in the speed of the NS cam 31*b* due to the release of the twist of the cam shaft 30. Accordingly, an increase in the impinging sound when the NS slider 33*b* comes in contact with the rotation stop area b1 of the NS cam 31*b* can be suppressed, and the decrease in the quietness of the image forming apparatus 1 can be suppressed.

Third Example Embodiment

Figure 12:
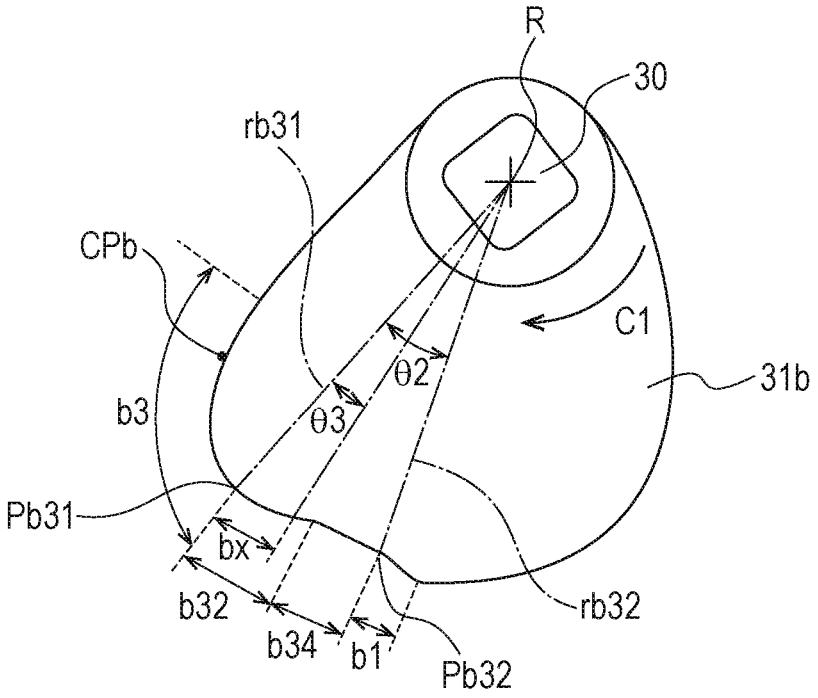
FIG. 12 is a side view of the NS cam.

Description of a third example embodiment will be given next. In the third example embodiment, a modification example of the cam shape of the NS cam 31*b* will be described. FIG. 12 is a diagram illustrating a shape of the NS cam 31*b*, and is a diagram viewed in the rotational axis R direction. FIG. 12 illustrates, as an example of the contact point CPb, a state in which the contact point CPb is situated in the radius increased area b3.

In the first example embodiment described above, the peripheral surface of the NS cam 31*b* is provided with the radius increased area b3, the radius uniform area b4, the radius decreased area b2, and the rotation stop area b1. In the NS cam 31*b* of the present example embodiment, as illustrated in FIG. 12, a radius decreased area b32 and a radius uniform area b34 are provided by switching positions of the radius uniform area b4 and the radius decreased area b2 of the first example embodiment with each other. In other words, the radius increased area b3, the radius decreased area b32, the radius uniform area b34, and the rotation stop area b1 are arranged on the peripheral surface of the NS cam 31*b* in that order in the C1 direction. Other configurations are the same as those of the first example embodiment; accordingly, description thereof is omitted.

In a state in which contact point CPb is situated at an upstream end portion Pb31 (a boundary point between the radius increased area b3 and the radius decreased area b32) of the radius increased area b3 in the C1 direction (the rotation direction), when the boundary point is a starting point, θ2 is a rotation amount of the NS cam 31*b* needed for the slider 33*b* to contact the rotation stop area b1. θ2 is an angle formed between a line segment rb31 connecting the boundary point Pb31 between the radius increased area b3 and the radius decreased area b32 and the rotational axis R, and a line segment rb32 connecting a boundary point Pb32 between the radius uniform area b34 and the rotation stop area b1 and the rotational axis R. Furthermore, the rotation amount θ2 is larger than the rotation amount θ1 (θ1<θ2). In other words, regarding the distances along the peripheral surfaces of the cams 31*a* and 31*b*, a sum of the radius decreased area b32 and the radius uniform area b34 is longer than the radius decreased area a2.

Accordingly, after passing through the radius increased area b3, when the contact point CPb of the NS cam 31*b* in contact with the NS slider 33*b* enters the radius decreased area b32, the twist of the cam shaft 30 becomes substantially released. In a state in which the contact point CPb is at the upstream end portion Pb31 of the radius increased area b3 in the C1 direction, when end portion is the starting point, the rotation amount of the NS cam 31*b* needed to substantially release the twist of the cam shaft 30 is denoted as θ3. Then, the rotation amount θ2 is set so that the rotation amount θ2 is larger than the rotation amount θ3 (θ3<θ2). In the peripheral surface of the NS cam 31*b*, an area from the upstream end portion Pb31, serving as a starting point, to where the contact point CPb comes in contact after moving rotation amount θ3 in the C1 direction is referred to as the twist releasing area bx. By providing the twist releasing area bx in the radius decreased area b32 in the above manner, the NS cam 31*b* receives, from the NS slider 33*b*, force in the direction releasing the twist of the cam shaft 30; accordingly, the twist of the cam shaft 30 can be released in a more reliable manner.

After the contact point CPb passes through the twist releasing area bx, the contact point CPb passes at least the radius uniform area b34. In the above, the NS cam 31*b* cannot receive, from the NS slider 33*b*, rotary force that rotates the NS cam 31*b* in the C1 direction. However, in the above, since the contact portion of the DS cam 31*a* is situated in the radius decreased area a2, the DS cam 31*a* rotates in the C1 direction with the rotary force from the DS slider 33*a* (see FIGS. 9A and 14A). Accordingly, since the rotary force is transmitted to the NS cam 31*b* through the cam shaft 30, the NS cam 31*b* can rotate until the NS slider 33*b* comes into contact with the rotation stop area b1.

Note that the rotation amount θ2 in the present example embodiment is set to have the same value as the rotation amount θ2 of the first example embodiment; however, the rotation amount θ2 may be any value that satisfies θ1<θ2 and θ3<θ2 described above. Furthermore in FIG. 12, regarding the distance along the peripheral surface of the NS cam 31*b*, the radius decreased area b32 is set so that the radius decreased area b32 is longer than the twist releasing area bx. However, not limited to the above, as long as θ1<θ2 and θ3<θ2 described above are satisfied, regarding the distance along the peripheral surface of the NS cam 31*b*, the radius decreased area b32 may be set so that the radius decreased area b32 is shorter than the twist releasing area bx.

According to the present example embodiment, after passing through the radius increased area b3, when the contact point CPb enters the radius decreased area b32, the twist of the cam shaft 30 becomes substantially released in the twist releasing area bx. Subsequently, the contact point of the DS cam 31*a* in contact with the DS slider 33*a* can be made to reach the radius decreased area a2. Accordingly, situations such as the DS cam 31*a* reaching the home position before the twist of the cam shaft 30 is released and the NS cam 31*b* not being able to reach the home position can be prevented.

Furthermore, even after the contact point CPb passes through the twist releasing area bx, there is at least the radius uniform area b34. Accordingly, after the contact point CPb has passed through the twist releasing area bx, when the contact point CPb is situated in the radius uniform area b34, there will be no increase in the speed of the NS cam 31*b* due to the release of the twist of the cam shaft 30. Accordingly, an increase in the impinging sound when the NS slider 33*b* comes in contact with the rotation stop area b1 of the NS cam 31*b* can be suppressed, and the decrease in the quietness of the image forming apparatus 1 can be suppressed.

Fourth Example Embodiment

Figure 15:
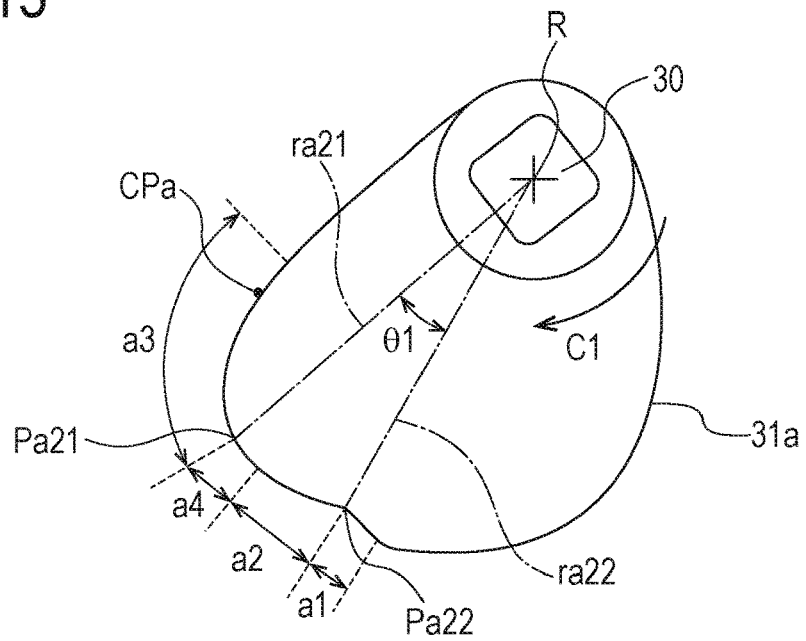
FIG. 15 is a side view of a DS cam.

Description of a fourth example embodiment will be given next. In the fourth example embodiment, a modification example of the cam shape of the DS cam 31*a* will be described. FIG. 15 is a diagram illustrating a shape of the DS cam 31*a*, and is a diagram viewed in the rotational axis R direction. FIG. 15 illustrates, as an example of the contact point CPa, a state in which the contact point CPa is situated in the radius increased area a3.

In the first example embodiment described above, the peripheral surface of the DS cam 31*a* is provided with the radius increased area a3, the radius decreased area a2, and the rotation stop area a1. As illustrated in FIG. 15, in the DS cam 31*b* of the present example embodiment, the DS cam 31*a* includes a radius uniform area a4 between the radius increased area a3 and the radius decreased area a2 in the C1 direction. Other configurations are the same as those of the first example embodiment; accordingly, description thereof is omitted.

The radius uniform area a4 is an area in which the distance (the radius to the cam surface) between a contact point CPb and the rotational axis (the rotation center) R is practically uniform (does not change) with the rotation of the DS cam 31*a* in the C1 direction. In a state in which a slider 33*a* is in contact with an upstream end portion Pa21 (the boundary point between the radius increased area a3 and the radius uniform area a4) of the radius increased area a3 in the C1 direction (the rotation direction), when the boundary is a starting point, θ1 is a rotation amount of the DS cam 31*a* needed for the slider 33*a* to contact the rotation stop area a1. In the present example embodiment, θ1 is an angle formed between a line segment ra21 connecting the boundary point Pa21 between the radius increased area a3 and the radius uniform area a2 and the rotational axis R, and a line segment ra22 connecting a boundary point Pa22 between the radius decreased area a2 and the rotation stop area a1 and the rotational axis R. Furthermore, the radius uniform area a4 and the radius decreased area a2 are set so that the rotation amount θ1 is smaller than the rotation amount θ2 (θ1<θ2).

Note that the rotation amount θ1 in the present example embodiment is set to have the same value as the rotation amount θ1 of the first example embodiment; however, the rotation amount θ1 may be any value that satisfies θ1<θ2 described above.

In the present example embodiment, the shapes of the radius uniform area a4 and the radius decreased area a2 are set so that the rotation amount θ2 is larger than the rotation amount θ1 (θ1<θ2) while providing, on the peripheral surface of the DS cam 31*a*, the radius uniform area a4 between radius increased area a3 and the radius decreased area a2 in the C1 direction.

By providing the radius uniform area a4 in the DS cam 31*a* in the above manner, the contact point of the DS cam 31*a* in contact with the DS slider 33*a* can be made to reach the radius decreased area a2 in a more reliable manner after the twisting of the cam shaft 30 has been substantially released. Accordingly, situations such as the DS cam 31*a* reaching the home position before the twist of the cam shaft 30 is released and the NS cam 31*b* not being able to reach the home position can be prevented.

Furthermore, similar to the first example embodiment, the contact point of the NS cam 31*b* in contact with the NS slider 33*b* reaches the radius decreased area b2 after the twist of the cam shaft 30 has been substantially released. Accordingly, when the NS cam 31*b* is rotating in the C1 direction while the NS slider 33*b* is in contact with the radius decreased area b2, there will be no increase in the speed of the NS cam 31*b* due to the release of the twist of the cam shaft 30. Accordingly, an increase in the impinging sound when the NS slider 33*b* comes in contact with the rotation stop area b1 of the NS cam 31*b* can be suppressed, and the decrease in the quietness of the image forming apparatus 1 can be suppressed.

Note that the modification example of the cam shape of the DS cam 31*a* described in the fourth example embodiment can be applied to the second example embodiment and the third example embodiment as well. In such a case as well, an advantage similar to the advantage described above can be obtained.

The present disclosure is capable of, in a case in which a rotation of a first cam between two cams becomes delayed relative to a rotation of a second cam, preventing a first cam from not reaching a stop position, and/or preventing a cam from coming into contact with a rotation restricting portion in a state in which the speed of the cam has been increased.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2017-147661 filed Jul. 31, 2017, which is hereby incorporated by reference herein in its entirety.

What is claimed is:

1. An image forming apparatus that forms an image on a recording material, the image forming apparatus comprising:

a drive source;

a first cam that comes in contact with a first cam follower, the first cam moving the first cam follower by being rotated by driving force transmitted thereto from the drive source; and a second cam that comes in contact with a second cam follower, the second cam moving the second cam follower by being rotated by driving force transmitted thereto from the drive source, wherein peripheral surfaces of the first and second cams each include, a radius increased area in which a distance between a portion to which a relevant one of the first and second cam follower comes in contact and a rotation center of relevant one of the first and second cam becomes larger as a relevant one of the first or second cam rotates, a radius decreased area in which a distance between a portion to which a relevant cam follower comes in contact and the rotation center of a relevant one of the first and second cam becomes smaller as a relevant one of the first or second cam rotates, and a rotation stop area that is capable of stopping a relevant one of the first and second cam by coming into contact with a relevant cam follower, wherein the radius increased area, the radius decreased area, and the rotation stop area are arranged on the peripheral surface of the first or second cam so as to be aligned in that order from a downstream side towards an upstream side in a rotation direction of the first or second cam, wherein a second driving force transmission path through which the driving force is transmitted from the drive source to the second cam is longer than a first driving force transmission path through which the driving force is transmitted from the drive source to the first cam, and wherein $\theta 1<\theta 2$ is satisfied where, in a state in which a portion in the peripheral surface of the first cam to which the first cam follower is in contact is positioned at an end portion of the radius increased area on an upstream side in the rotation direction, when the end portion is a starting point, a rotation amount of the first cam needed until the first cam follower comes in contact with the rotation stop area is $\theta 1$, and in a state in which a portion in the peripheral surface of the second cam to which the second cam follower is in contact is positioned at an end portion of the radius increased area on an upstream side in the rotation direction, when the end portion is a starting point, a rotation amount of the second cam needed until the second cam follower comes in contact with the rotation stop area is $\theta 2$.

2. The image forming apparatus according to claim 1, wherein the peripheral surface of the second cam includes a radius uniform area in which a distance between a portion where the second cam follower comes in contact and the rotation center of the second cam is substantially uniform while the second cam rotate, wherein the radius uniform area is disposed in the peripheral surface of the second cam between the radius increased area and the radius decreased area in a rotation direction of the second cam, and wherein the radius decreased area in the peripheral surface of the first cam is disposed in the peripheral surface of the first cam adjacent to the radius increased area in the rotation direction of the first cam.

3. The image forming apparatus according to claim 1, wherein the radius decreased area in the peripheral surface of the first cam is disposed in the peripheral surface of the first cam adjacent to the radius increased area in the rotation direction of the first cam;

wherein the radius decreased area in the peripheral surface of the second cam is disposed in the peripheral surface of the second cam adjacent to the radius increased area in the rotation direction of the second cam, wherein in a state in which a portion of the peripheral surface of the first cam to which the first cam follower is in contact is positioned at a boundary point between the radius increased area and the radius decreased area, when the boundary point is a starting point, a rotation amount of the first cam needed until the first cam follower comes in contact with the rotation stop area is $\theta 1$, and wherein in a state in which the portion of the peripheral surface of the second cam to which the second cam follower is in contact is positioned at a boundary point between the radius increased area and the radius decreased area, when the boundary point is a starting point, a rotation amount of the second cam needed until the second cam follower comes in contact with the rotation stop area is $\theta 2$.

4. The image forming apparatus according to claim 1, wherein the peripheral surfaces of the first and second cams each include a radius uniform area in which a distance between a portion where the relevant one of the first and second cam followers comes in contact and the rotation center of the relevant one of the first and second cams is substantially uniform while the relevant one of the first and second cams rotate.

5. The image forming apparatus according to claim 1, wherein a rotational axis of the first cam and a rotational axis of the second cam are substantially parallel to each other, and wherein when the first cam follower is in contact with the rotation stop area of the first cam and the rotation of the first cam is stopped and when the second cam follower is in contact with the rotation stop area of the second cam and the rotation of the second cam is stopped, the rotation stop area of the first cam and the rotation stop area of the second cam are disposes at same phase in the rotation directions of the first and second cams.

6. The image forming apparatus according to claim 1, wherein a first timing, the first timing being a timing at which a portion of the peripheral surface of the first cam to which the first cam follower comes in contact reaches the end portion of the radius increased area of the first cam on the upstream side in the rotation direction, is delayed with respect to a second timing, the second timing being a timing at which a portion of the peripheral surface of the second cam to which the second cam follower comes in contact reaches the end portion of the radius increased area of the second cam on the upstream side in the rotation direction.

7. The image forming apparatus according to claim 6, wherein a third timing, the third timing being a timing at which a portion of the peripheral surface of the first cam to which the first cam follower comes in contact reaches the rotation stop area of the first cam, is same as a fourth timing, the fourth timing being a timing at which a portion of the peripheral surface of the second cam to which the second cam follower comes in contact, or a time difference between the third timing and the fourth timing is smaller than a time difference between the first timing and the second timing.

8. The image forming apparatus according to claim 1, wherein when the first cam follower is in contact with the radius decreased area of the first cam, the first cam is rotated by pressing force from the first cam follower, and when the second cam follower is in contact with the radius decreased area of the second cam, the second cam is rotated by pressing force from the second cam follower.

9. The image forming apparatus according to claim 1, wherein a developer image is formed by supplying developer to a photosensitive member from a developer bearing member, and an image is formed on the recording material by transferring the developer image thereto, and by moving the first cam follower and the second cam follower with the first cam and the second cam, a position of the developer bearing member with respect to the photosensitive member is changed.

10. The image forming apparatus according to claim 9, wherein the developer bearing member is supported by a developing frame that is rotatable relative to the photosensitive member, and the first cam follower and the second cam follower are capable of changing a position of the developer bearing member with respect to the photosensitive member by engaging with the developing frame and moving the developing frame.

11. An image forming apparatus that forms an image on a recording material, the image forming apparatus comprising:

a drive source;

a shaft provided with a drive input portion to which driving force from the drive source is input, the shaft being rotated by the driving force from the drive input portion;

a first cam that comes in contact with a first cam follower, the first cam being fixed to the shaft and moving the first cam follower by being rotated by a rotation of the shaft; and a second cam that comes in contact with a second cam follower, the second cam being fixed to the shaft and moving the second cam follower by being rotated by a rotation of the shaft, wherein peripheral surfaces of the first and second cams each include, a radius increased area in which a distance between a portion to which a relevant cam follower comes in contact and a rotation center of a relevant one of the first and second cam becomes larger as a relevant one of the first or second cam rotates, a radius decreased area in which a distance between a portion to which a relevant cam follower comes in contact and the rotation center of a relevant one of the first and second cam becomes smaller as a relevant one of the first or second cam rotates, and a rotation stop area that is capable of stopping a relevant one of the first and second cam by coming into contact with a relevant cam follower, wherein the radius increased area, the radius decreased area, and the rotation stop area are arranged on the peripheral surface of the first or second cam so as to be aligned in that order from a downstream side towards an upstream side in a rotation direction of the first or second cam, wherein in a rotational axis direction of the shaft, the second cam is disposed as a position that is farther away from the drive input portion than the first cam, and wherein $\theta 1<\theta 2$ is satisfied where, in a state in which a portion in the peripheral surface of the first cam to which the first cam follower is in contact is positioned at an end portion of the radius increased area on an upstream side in the rotation direction, when the end portion is a starting point, a rotation amount of the first cam needed until the first cam follower comes in contact with the rotation stop area is $\theta 1$, and in a state in which a portion in the peripheral surface of the second cam to which the second cam follower is in contact is positioned at an end portion of the radius increased area on an upstream side in the rotation direction, when the end portion is a starting point, a rotation amount of the second cam needed until the second cam follower comes in contact with the rotation stop area is $\theta 2$.

12. The image forming apparatus according to claim 11, wherein the peripheral surface of the second cam includes a radius uniform area in which a distance between a portion where the second cam follower comes in contact and the rotation center of the second cam is substantially uniform while the second cam rotate, wherein the radius uniform area is disposed in the peripheral surface of the second cam between the radius increased area and the radius decreased area in a rotation direction of the second cam, and wherein the radius decreased area in the peripheral surface of the first cam is disposed in the peripheral surface of the first cam adjacent to the radius increased area in the rotation direction of the first cam.

13. The image forming apparatus according to claim 11, wherein the radius decreased area in the peripheral surface of the first cam is disposed in the peripheral surface of the first cam adjacent to the radius increased area in the rotation direction of the first cam, wherein the radius decreased area in the peripheral surface of the second cam is disposed in the peripheral surface of the second cam adjacent to the radius increased area in the rotation direction of the second cam, wherein in a state in which a portion of the peripheral surface of the first cam to which the first cam follower is in contact is positioned at a boundary point between the radius increased area and the radius decreased area, when the boundary point is a starting point, a rotation amount of the first cam needed until the first cam follower comes in contact with the rotation stop area is $\theta 1$, and wherein in a state in which the portion of the peripheral surface of the second cam to which the second cam follower is in contact is positioned at a boundary point between the radius increased area and the radius decreased area, when the boundary point is a starting point, a rotation amount of the second cam needed until the second cam follower comes in contact with the rotation stop area is $\theta 2$.

14. The image forming apparatus according to claim 11, wherein the peripheral surfaces of the first and second cams each include a radius uniform area in which a distance between a portion where the relevant one of the first and second cam followers comes in contact and the rotation center of the relevant one of the first and second cams is substantially uniform while the relevant one of the first and second cams rotate.

15. The image forming apparatus according to claim 11, wherein a rotational axis of the first cam and a rotational axis of the second cam are substantially parallel to each other, and wherein when the first cam follower is in contact with the rotation stop area of the first cam and the rotation of the first cam is stopped and when the second cam follower is in contact with the rotation stop area of the second cam and the rotation of the second cam is stopped, the rotation stop area of the first cam and the rotation stop area of the second cam are disposes at same phase in the rotation directions of the first and second cams.

16. The image forming apparatus according to claim 11, wherein a first timing, the first timing being a timing at which a portion of the peripheral surface of the first cam to which the first cam follower comes in contact reaches the end portion of the radius increased area of the first cam on the upstream side in the rotation direction, is delayed with respect to a second timing, the second timing being a timing at which a portion of the peripheral surface of the second cam to which the second cam follower comes in contact reaches the end portion of the radius increased area of the second cam on the upstream side in the rotation direction.

17. The image forming apparatus according to claim 16, wherein a third timing, the third timing being a timing at which a portion of the peripheral surface of the first cam to which the first cam follower comes in contact reaches the rotation stop area of the first cam, is same as a fourth timing, the fourth timing being a timing at which a portion of the peripheral surface of the second cam to which the second cam follower comes in contact, or a time difference between the third timing and the fourth timing is smaller than a time difference between the first timing and the second timing.

18. The image forming apparatus according to claim 11, wherein when the first cam follower is in contact with the radius decreased area of the first cam, the first cam is rotated by pressing force from the first cam follower, and when the second cam follower is in contact with the radius decreased area of the second cam, the second cam is rotated by pressing force from the second cam follower.

19. The image forming apparatus according to claim 11, wherein a developer image is formed by supplying developer to a photosensitive member from a developer bearing member, and an image is formed on the recording material by transferring the developer image thereto, and by moving the first cam follower and the second cam follower with the first cam and the second cam, a position of the developer bearing member with respect to the photosensitive member is changed.

20. The image forming apparatus according to claim 19, wherein the developer bearing member is supported by a developing frame that is rotatable relative to the photosensitive member, and the first cam follower and the second cam follower are capable of changing a position of the developer bearing member with respect to the photosensitive member by engaging with the developing frame and moving the developing frame.

* * * * *